United States Patent [19]

Sakamoto et al.

[11] Patent Number: 4,871,658

[45] Date of Patent: Oct. 3, 1989

[54] SILVER HALIDE PHOTOGRAPHIC MATERIAL THAT IS RESISTANT TO FOGGING DURING STORAGE

[75] Inventors: Eiichi Sakamoto; Yutaka Kaneko; Hidetaka Ninomiya; Takashi Kamio; Atsuo Ezaki; Hideo Akamatsu; Hideaki Haraga, all of Hino, Japan

[73] Assignee: Konishiroku Photo Industry Co., Ltd., Tokyo, Japan

[21] Appl. No.: 279,081

[22] Filed: Dec. 2, 1988

Related U.S. Application Data

[63] Continuation of Ser. No. 4,579, Jan. 20, 1987, abandoned.

[30] Foreign Application Priority Data

| | | | |
|---|---|---|---|
| Jan. 24, 1986 | [JP] | Japan | 61-14536 |
| Feb. 20, 1986 | [JP] | Japan | 61-35500 |
| Feb. 21, 1986 | [JP] | Japan | 61-37622 |
| Feb. 21, 1986 | [JP] | Japan | 61-37623 |
| Feb. 21, 1986 | [JP] | Japan | 61-37624 |

[51] Int. Cl.[4] ..... G03C 1/34; G03C 7/36; G03C 7/38

[52] U.S. Cl. ..... 430/551; 430/556; 430/557; 430/558; 430/567; 430/614

[58] Field of Search ..... 430/614, 551, 567, 556, 430/557, 558, 613

[56] References Cited

U.S. PATENT DOCUMENTS

| | | | |
|---|---|---|---|
| 2,592,250 | 4/1952 | Davey et al. | 430/569 |
| 3,352,672 | 11/1967 | Hoppe | 430/613 |
| 3,592,656 | 7/1971 | Brooks et al. | 96/126 |
| 3,615,616 | 10/1971 | Willems et al. | 430/614 |
| 3,704,130 | 11/1972 | Pollet et al. | 96/114.7 |
| 3,808,005 | 4/1974 | Willems et al. | 430/614 |
| 4,476,219 | 10/1984 | Sakanoue et al. | 430/557 |
| 4,565,778 | 1/1986 | Miyamoto et al. | 430/567 |
| 4,618,573 | 10/1986 | Okamura et al. | 430/558 |

OTHER PUBLICATIONS

Research Disclosure No. 13651 (Aug., 1975), pp. 39–41.

*Primary Examiner*—Paul R. Michl
*Assistant Examiner*—Mark R. Buscher
*Attorney, Agent, or Firm*—Finnegan, Henderson, Farabow, Garrett, and Dunner

[57] ABSTRACT

A silver halide photographic material is disclosed which comprises a support coated with photographic layers including one or more silver halide emulsion layers, at least one of said silver halide emulsion layers containing silver halide grains with a silver iodide content of 3.0–15 mol %, and at least one of said photographic layers containing a compound represented by the following general formula (I):

(I)

where Y is an aromatic group or a 5- or 6-membered heterocyclic group.

5 Claims, No Drawings

SILVER HALIDE PHOTOGRAPHIC MATERIAL THAT IS RESISTANT TO FOGGING DURING STORAGE

This application is a continuation of application Ser. No. 4,579 filed Jan. 20, 1987, now abandoned.

FIELD OF THE INVENTION

The present invention relates to a silver halide photographic material and, in particular, to a silver halide photographic material that is rendered resistant to fogging during storage.

BACKGROUND OF THE INVENTION

Silver halide photographic materials have a tendency to experience fogging on account of the presence of nuclei that develop in the absence of exposure. Fogging that occurs during storage is in most cases prone to have adverse effects on photographic materials such as a decreased sensitivity and deteriorated gradation.

In order to minimize these undesirable effects, the addition of antifoggants or stabilizers to silver halide emulsions has been proposed. For example, U.S. Pat. Nos. 2,403,927 and 3,804,633 and Japanese Patent Publication No. 2825/1964 show the use of 1-phenyl-5-mercaptotetrazoles or 4-hydroxy-6-methyl-1,3,3a,7-tetrazaindene as fog restrainers. However, these compounds are not completely satisfactory in their ability to inhibit fogging during storage of photographic materials. They have the additional disadvantage of decreasing the sensitivity of the photographic material or deteriorating its gradation. If fog restrainers are incorporated in color photographic materials with a view to improving their storage stability, the adsorption of the restrainers on silver halide emulsions is so strong as to cause undesirable phenomena such as impairing the spectral sensitivity of the material or retarding silver removal during development. These adverse effects are pronounced in high-sensitivity photographic materials having high silver iodide contents and there has existed a strong need to develop a method that is capable of eliminating them.

SUMMARY OF THE INVENTION

An object, therefore, of the present invention is to provide a silver halide photographic material that is protected against any deterioration of its photographic performance, in particular fogging, during storage.

Another object of the present invention is to provide a silver halide photographic material that contains a fog restrainer which has no potential for causing decreased sensitivity or deteriorated gradation due to restrained development.

Still another object of the present invention is to provide a silver halide photographic material that undergoes only a minimum degree of fogging even if it is developed at high temperatures, especially at 30° C. or higher.

These objects of the present invention can be attained by a silver halide photographic material that comprises a support which is coated with photographic layers including one or more silver halide emulsion layers, wherein at least one of said silver halide emulsion layers contains silver halide grains with a silver iodide content of 3.0–15 mol % and at least one of said photographic layers contains a compound represented by the following general formula (I):

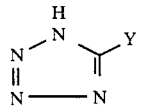

(I)

where Y is an aromatic group or a 5- or 6-membered heterocyclic group.

DESCRIPTION OF THE PREFERRED EMBODIMENT

As is well known to those skilled in the art, photographic characteristics are largely dependent on the halide composition and content of silver halide grains present in a silver halide emulsion and an increase in the silver iodide content generally contributes to a sufficient growth of grains to produce a high-sensitivity emulsion.

A higher silver iodide content is inevitably desired for light-sensitive materials that are intended for taking pictures and which hence require high sensitivity and a broad range of exposure. However, photographic materials whose sensitivity has been increased by use of an increased amount of silver iodide are highly likely to experience fogging during storage and this tendency is enhanced by chemical ripening.

The term "silver iodide content" as used herein covers two cases, one in which a silver iodide is distributed uniformly throughout the silver halide grains and the other in which more of the silver iodide is present in the interior of grains than on their surface.

Various proposals have been made with respect to the preparation of silver iodide containing emulsions and they can be prepared by methods described in many references such as, for example: P. Glafkides, Chimie et Physique Photographique, Paul Montel, 1967; G. F. Duffin, Photographic Emulsion Chemistry, The Focal Press, 1966; and V. L. Zelikman et al., Making and Coating Photographic Emulsions, The Focal Press, 1964.

The silver halide grains in accordance with the present invention have a silver halide content of 3.0–15 mol %, preferably 4.0–10 mol %. The silver halides that can be used are silver iodobromide, silver iodochlorobromide, and silver iodochloride. The average particle size of the silver halide grains is not limited to any particular value but preferable range is from 0.1 to 3 μm, with the range of 0.2–2 μm being more preferable.

It suffices for the purposes of the present invention that these silver halide grains are incorporated in at least one silver halide emulsion layer. Preferably, these silver halide grains are used in amounts of at least 20 wt %, more preferably at least 50 wt %, of the silver halide grains present in the coatings of silver halide emulsion layer or layers that contain the silver halide grains of the present invention. More specific information on the silver halide used in the present invention will be given later in this specification.

The present invention is also characterized by using a compound of formula (I) as an antifoggant. In formula (I), Y signifies an aromatic group, such as a benzene ring, or a 5- or 6-membered heterocyclic group. The aromatic group signified by Y is preferably an aryl group such as phenyl or naphthyl. The 5- or 6-membered heterocyclic group signified by Y may be a condensed ring, and illustrative heterocyclic groups include: 2-pyridyl, 3-pyridyl, 4-pyridyl, 2-quinolyl, 3-quinolyl, 4-quinolyl, 6-quinolyl, 2-thienyl, 3-furyl, 3-pyrolyl, 2-imidazolyl, 2-pyrimidinyl, 3-pyridazinyl, 3-isoquinoly, 2-thiazolyl, and 5,6-benzo-1,4-diazinyl.

The aforementioned aromatic groups and heterocyclic groups may have substituents such as: a halogen atom (e.g., Cl, Br or I), a hydroxyl group, an amino group, a cyano group, a nitro group, a carboxyl group or a salt thereof, a sulfo group or a salt thereof, an alkyl group (e.g., methyl, ethyl, sec-pentyl or octyl), an alkoxy group (e.g., methoxy, ethoxy or 2-ethylhexyloxy), an aryl group (e.g., phenyl or naphthyl), and an aryloxy group (e.g., phenoxy or phenethyloxy).

A 5- or 6-membered heterocyclic group is a preferable example of Y in formula (I) and a more preferable example is a group that is represented by the following general formula (I-1) and a further more preferable example is a group that is represented by the following general formula (I-2):

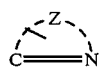

(I-1)

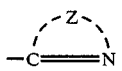

(I-2)

where Z signifies the nonmetallic atomic group necessary to form a 5- or 6-membered heterocyclic ring.

The nitrogenous heterocyclic ring in formula (I-1) that is formed by

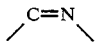

and Z may be attached to a condensed ring such as a benzene ring; said ring may further contain a substituent illustrated for the group signified by Y in formula (I).

Typical examples of the compound represented by formula (I) (hereinafter referred to as the compound of the present invention) are listed below but it should be noted that they are by no means intended to limit the present invention.

Illustrative compounds (I):

(1)

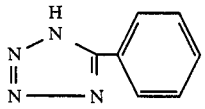

(2)

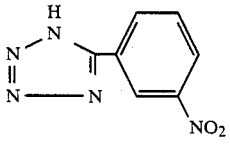

(3)

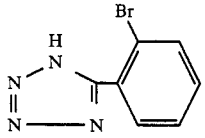

(4)

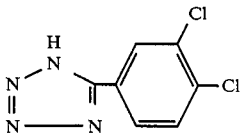

-continued

Illustrative compounds (I):

(5)

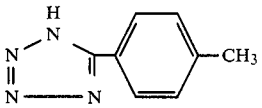

(6)

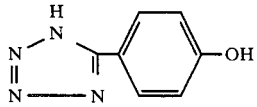

(7)

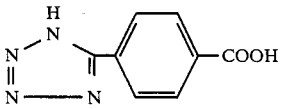

(8)

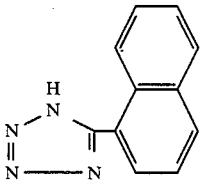

(9)

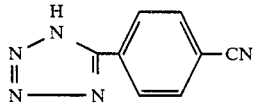

(10)

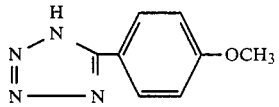

(11)

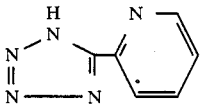

(12)

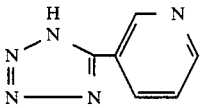

(13)

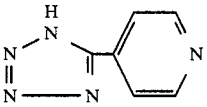

(14)

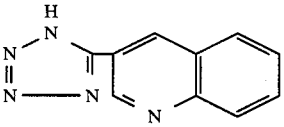

(15)

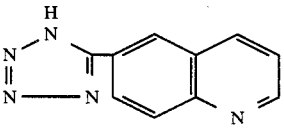

(16)

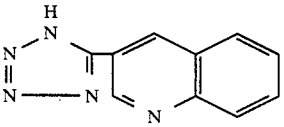

-continued

Illustrative compounds (I):

(17)

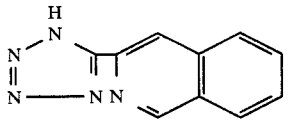

(18)

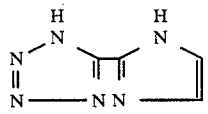

(19)

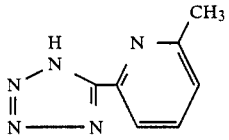

(20)

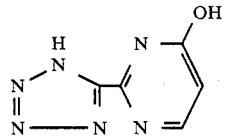

(21)

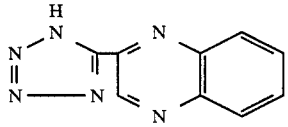

Many examples of the compound of the present invention have been reported in abstracts and journals such as Beilsteins Handbuch der Organischen Chemie, Chemical Abstracts, and Journal of the American Chemical Society, and may be readily synthesized by the methods described in these abstracts and journals.

The compound of the present invention may be incorporated not only in silver halide emulsion layers but also in other photographic layers that are formed in ordinary silver halide light-sensitive materials such as protective layers, intermediate layers, filter layers, antihalation layers and subbing layers. It is particularly preferable that the compound of the present invention be incorporated in silver halide emulsion layers and hydrophilic colloid layers that are adjacent to such emulsion layers.

The amount in which the compound of the present invention is added varies with the type of light-sensitive material and compound employed and is preferably within the range of $1\times10^{-5}$ to $1\times10^{-1}$ mol per mole of silver halide, with the range of $1\times10^{-4}$ to $1\times10^{-2}$ mol per mole of silver halide being particularly preferable. If the compound of the present invention is incorporated in a hydrophilic colloid layer that is adjacent to emulsion layers, it is preferably added in an amount of 10–1,000 mg/m$^2$, more preferably 100–700 mg/m$^2$.

The present invention does not preclude the use of known fog restrainers or stabilizers in combination with the compound of the present invention in amounts that will not be detrimental to the purposes of the present invention. Known antifoggants or stabilizers that can be used in combination with the compound of the present invention include: azoles such as benzothiazole, nitroindazole, benzotriazole and nitrobenzimidazole; mercapto-substituted heterocyclic compounds such as mercaptobenzothiazole, mercaptobenzimidazole, mercaptobenzoxazole, mercaptoxadiazole, mercaptothiadiazole, mercaptotriazole, mercaptotriazine and mercaptotetrazoles (e.g., 1-phenyl-5-mercaptotetrazole); modifications of these mercapto-substituted heterocyclic compounds which have a sulfonic acid group or carboxyl group introduced hereinto; azaindenes such as 4-hydroxy-1,3,3a,7-tetrazaindene; quaternary onium salts such as the thiazolium salts described in U.S. Pat. Nos. 2,131,088, 3,342,596 and 3,954,478, the pyrilium salt described in U.S. Pat. No. 3,148,067, and the phosphonium salt described in Japanese Patent Publication No. 40665/1975; polyhydroxybenzenes such as the catechols described in U.S. Pat. No. 3,236,652 and Japanese Patent Publication No. 10256/1968, the resorcins described in Japanese Patent Publication No. 44413/1981 and the gallic acid esters described in Japanese Patent Publication No. 4133/1968; azoles such as the tetrazoles described in German Patent No. 1,189,380, the triazoles described in U.S. Pat. No. 3,157,509, the benzotriazoles described in U.S. Pat. No. 2,704,721, the urazoles described in U.S. Pat. No. 3,287,135, the pyrazoles described in U.S. Pat. No. 3,106,467, the indazoles described in U.S. Pat. No. 2,271,229, and the polymerized benzotriazoles described in Japanese Patent Application (OPI) No. 90844/1984 (the term "OPI" as used herein means an unexamined published Japanese patent application); heterocyclic compounds such as the pyrimidines described in U.S. Pat. No. 3,161,515, 3-pyrazolidones described in U.S. Pat. No. 2,751,297 and the polymerized pyrrolidone (i.e., polyvinyl pyrrolidone) described in U.S. Pat. No. 3,021,213; restrainer precursors of various types as described in Japanese Patent Application (OPI) Nos. 130929/1979, 137945/1984, 140445/1984, British Patent No. 1,356,124, U.S. Pat. Nos. 3,575,699 and 3,649,267; the sulfinic acid and derivatives thereof described in U.S. Pat. No. 3,047,393; and the inorganic salts described in U.S. Pat. Nos. 2,556,263, 2,839,405, 2,488,709 and 2,728,663.

If the compound of the present invention is incorporated in a silver halide emulsion, it is preferably added during or after chemical ripening or before emulsion coating which follows chemical ripening. More preferably, the compound of the present invention is added to a silver halide emulsion after its chemical ripening has been completed.

The compound of the present invention, or 1H-5-substituted tetrazole, was already reported by Murofushi and Ashikawa in kokashi (Kogyo Kagaku Zasshi), 57, 232–233 (1954), in which they proposed the use of that compound in a photographic emulsion as an artificial restrainer. However, in the experiment they conducted using a neutral emulsion to which the restrainer had been added immediately before chemical ripening, it proved to be less effective than 1-phenyl-5-mercaptotetrazole which had conventionally been used as a fog restrainer. It was therefore entirely unexpected that this compound was found to be capable of inhibiting the occurrence of fogging during high-temperature development of a high-sensitivity photographic material of the type contemplated by the present invention which had a high silver iodide content and that the effectiveness of the compound was found to be superior to 1-phenyl-5-mercaptotetrazole.

The light-sensitive material of the present invention is adapted for use in various applications such as black-and-white photography, X-ray recording, photographic platemaking, color positives, color negatives, color paper, reversal color photography, direct positives, and photographic materials for processing by thermal development. The concept of the present invention is applied with particular advantage to a multi-layered color photographic material.

The silver halide grains used in silver halide emulsions may be prepared by any suitable method selected from among the acid process, neutral process and ammoniacal process. The grains may be allowed to grow uninterruptedly or preliminarily formed seed grains may be permitted to grow. The formation and growth of seed grains may be achieved by the same or different methods.

A silver halide emulsion may be prepared by either the double-jet method or the single-jet method. It may also be prepared by adding silver halide ions and silver ions, either successively or simultaneously, with the pH and/or pAg in the reactor being controlled in consideration of the critical growth rate of the silver halide crystals. This method enables the formation of silver halide grains that have a regular crystallographic shape and a uniform particle size. A converted emulsion may be formed by changing the halide composition of grown grains.

A silver halide solvent may optionally be used to control the particle size of the silver halide grains being formed, their shape, size distribution and the rate at which they are allowed to grow.

The silver halide grains to be used in the silver halide emulsions of the present invention may have metal ions incorporated inside the grains and/or in the grain surfaces in the course of forming and/or growing the grains by using at least one salt selected from among cadmium salts, zinc salts, lead salts, thallium salts, iridium salts or complex salts thereof, rhodium salts or complex salts thereof, and iron salts or complex salts thereof. Said grains may also be placed in an appropriate reduction atmosphere to have reduction-sensitized specks imparted inside the grains and/or into the grain surfaces.

The silver halide emulsions of the present invention may be freed of unnecessary soluble salts after completion of the growth of the silver halide grains or may be left as they are containing such salts. In removing said salts; the method described in Research Disclosure No. 17643 II, may be used.

The silver halide grains to be used in the silver halide emulsions of the present invention may have a homogeneous structure throughout the crystal, or the structure of the core may be different from that of the shell. In the silver halide photographic material of the present invention that employs both silver halide grains with a silver iodide content of 3.0–15 mol % and the compound of the present invention having the formula (I), it is advantageous to use core/shell type silver halide grains as the silver halide grains having a silver iodide content of 3.0–15 mol %. By using such core/shell type silver halide grains, a further improvement in high-sensitivity characteristics can be attained without causing any adverse effects on the ability of the compound of the present invention to restrain the occurrence of fogging in the light-sensitive material being stored.

The core/shell type silver halide grains which are preferably used in the present invention are described hereinafter.

The core/shell type silver halide grains have an average silver iodide content of 3.0–15 mol % and each grain is composed of two or more layers having different silver iodide contents, with the layer having a maximum silver iodide content (i.e., core) being different from the outermost layer (i.e., shell).

The inner layer (core preferably has a AgI content of 6–40 mol %, more preferably 8–30 mol %, and most preferably 10–20 mol %. The outermost layer has a AgI content of less than 6 mol %, more preferably 0–4.0 mol %.

The proportion of a core/shell type silver halide grain that is taken by the shell preferably ranges from 10 to 80%, more preferably from 15 to 70%, and most preferably from 20 to 60%. The core desirably assumes 10–80% of all the grains, with the range of 20–50% being more preferable.

The AgI content in the core of the silver halide grains may form a sharp boundary with the AgI content in the shell. The boundary need not be sharp and the AgI content in the core may change gradually to the content in the shell. It is also preferable to use silver halide grains wherein an intermediate layer having a AgI content intermediate between those of the core and shell is present between the core and the shell.

In the last-mentioned case, the intermediate layer preferably assumes 5–60%, more preferably 20–55%, of the total volume of the grains. The difference in AgI content between the shell and the intermediate layer and between the intermediate layer and the core is preferably at least 3 mol %, with the difference in AgI content between the shell and the core being preferably at least 6 mol %.

The core/shell type silver halide emulsion used in the present invention is preferably a silver iodobromide with an average silver iodide content of 4–15 mol %, more preferably 5–15 mol %. The emulsion may also contain silver chloride in an amount that will not impair the objects of the present invention.

The core/shell type silver halide emulsion which is preferably used in the present invention may be prepared by any of the known methods described in Japanese Patent Application (OPI) Nos. 177535/1984, 138538/1975, 52238/1984, 143331/1985, 35726/1985 and 258536/1985. When a core/shell type silver halide emulsion is allowed to grow from seed grains as in the practice of the method described in the Examples given in Japanese Patent Application (OPI) No. 138538/1985, the resulting grains may have a silver halide composition in the center that differs from the composition possessed by the core. In this case, the seed grains employed may have any desired halide composition such as silver bromide, silver iodobromide, silver chloroiodobromide, silver chlorobromide or silver chloride. Preferably silver bromide or silver iodobromide having a silver iodide content of no more than 10 mol % is used. The proportion of the silver halide taken by the seed emulsion is preferably not more than 50%, with no more than 10% being particularly preferable.

The distribution of silver iodide in the core/shell silver halide grains can be detected by a variety of methods of physical measurement known in the art. For example, the luminescence determination at low temperatures and the X-ray diffractiometry described in the Proceedings of 1981 Annual Meeting of the Society of Photographic Science and Technology of Japan may be used for this purpose.

The core/shell type silver halide grains may have regular crystallographic shapes (e.g., cubic, tetradecahedral or octahedral) or may be twinned. While these crystallographic shapes may be mixed together, grains having a regular shape are preferable.

These silver halide grains may be of the surface type where latent images are predominantly formed on the grain surface or of the internal type where latent images are formed within the grain.

The silver halide grains used in the silver halide emulsion in accordance with the present invention may have regular crystal shapes such as cubic, octahedral and tetradecahedral forms. The grains may have anomalous crystal shapes such as spherical and tabular forms. These grains may have any desired values for the ratio of {100} to {111} faces. The grains may have combinations of various crystal forms, or grains having different crystal forms may be used in mixture.

The silver halide emulsion used in the present invention may have any pattern of grain size distribution, broad or narrow. Emulsions having a broad distribution (referred to as polydispersed emulsions) may be used either independently or in combination. Also suitable for use are emulsions having a narrow distribution (i.e., monodispersed emulsions which may be defined as those emulsions whose standard deviation of size distribution divided by the average grain size is no more than 0.20; the grain size is expressed as the diameter of a spherical grain and as the diameter of an equivalent circle for the projected area of a non-spherical grain). Polydispersed emulsions may be used in combination with monodispersed emulsions.

The silver halide emulsion of the present invention may be a mixture of two or more silver halide emulsions prepared separately.

The silver halide emulsion of the present invention is chemically sensitized by an ordinary method, such as sulfur sensitization, selenium sensitization, reduction sensitization, or noble metal sensitization using gold and other noble metal compounds. Such methods may be used each independently or in combination.

The silver halide emulsion of the present invention may be optically sensitized to a desired range of wavelength, using dyes known as sensitizing dyes in the photographic industry. Sensitizing dyes may be employed either singly or in combination. Supersensitizers that are either dyes incapable of spectral sensitization by themselves or compounds substantially incapable of absorbing visible rays and which are capable of increasing the sensitizing effect of the sensitizing dyes may be incorporated in the photographic emulsion together with the sensitizing dyes.

Exemplary sensitizing dyes used in the present invention include cyanine dyes, merocyanine dyes, complex cyanine dyes, complex merocyanine dyes, holopolar cyanine dyes, hemicyanine dyes, styryl dyes and hemioxanole dyes.

Particularly useful dyes are cyanine dyes, merocyanine dyes and complex merocyanine dyes. These dyes may employ any of the following nuclei commonly used in cyanine dyes as basic heterocyclic nuclei: pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus and nucleus having an alicyclic hydrocarbon ring fused to any one of these nuclei; and nuclei having an aromatic hydrocarbon ring fused to these nuclei, such as indolenine nucleus, benzindolenine nucleus, indole nucleus, benzoxazole nucleus, naphthaoxazole nucleus, benzothiazole nucleus, naphthothiazole nucleus, benzoselenazole nucleus, benzimidazole nucleus and quinoline nucleus. These nuclei may be substituted on a carbon atom.

Merocyanine or complex merocyanine dyes may contain 5- or 6-membered heterocyclic nuclei as nuclei having the ketomethylene structure, and examples of such nuclei are a pyrazolin-5-one nucleus, thiohydantoin nucleus, 2-thioxaxolidine-2,4-dione nucleus, thiazolidine-2,4-dione nucleus, rhodanine nucleus and a thiobarubituric acid nucleus.

Sensitizing dyes useful in blue-sensitive silver halide emulsion layers are illustrated by those described in West German Patent No. 929,080; U.S. Pat. Nos. 2,231,658, 2,493,748, 2,503,776, 2,519,001, 2,912,329, 3,656,959, 3,672,897, 3,694,217, 4,025,349, and 4,046,572; British Patent No. 1,242,588; and Japanese Patent Publication Nos. 14030/1969 and 24844/1977. Typical examples of the sensitizing dyes useful in green-sensitive silver halide emulsion layers are the cyanine, merocyanine and complex cyanine dyes shown in U.S. Pat. Nos. 1,939,201, 2,072,908, 2,739,149, and 2,945,763; and British Patent No. 505,979. Typical examples of the sensitizing dyes useful in red-sensitive silver halide emulsion layers are the cyanine, merocyanine and complex cyanine dyes shown in U.S. Pat. Nos. 2,269,234, 2,270,378, 2,442,710, 2,454,629, and 2,776,280. The cyanine, merocyanine and complex cyanine dyes described in U.S. Pat. Nos. 2,213,995, 2,493,748 and 2,519,001, and West German Patent No. 929,080 may be advantageously used in green- or redsensitive silver halide emulsions.

These sensitizing dyes may be employed either singly or in combination. In particular, combinations of sensitizing dyes are often used for the purpose of supersensitization. Typical examples of the combinations of sensitizing dyes are found in Japanese Patent Publication Nos. 4932/1968, 4933/1968, 4936/1968, 32753/1969, 25831/1970, 26474/1970, 11627/1971, 18107/1971, 8741/1972, 11114/1972, 25379/1972, 37443/1972, 28293/1973, 38406/1973, 38407/1973, 38408/1973, 41203/1973, 41204/1973, 6207/1974, 40662/1975, 12375/1978, 34535/1979, and 1569/1980: Published Japanese Patent Application (OPI) Nos. 33220/1975, 33828/1975, 38526/1975, 107127/1976, 115820/1976, 135528/1976, 151527/1976, 23931/1977, 51932/1977, 104916/1977, 104917/1977, 109925/1977, 110618/1977, 80118/1979, 25728/1981, 1438/1982, 10753/1983, 91445/1983, 153926/1983, 114533/1984, 116645/1984 and 116647/1984; and U.S. Pat. Nos. 2,688,545, 2,977,229, 3,397,060, 3,506,443, 3,578,447, 3,672,898, 3,679,428, 3,769,301, 3,814,609 and 3,837,862.

Examples of the substances that are either dyes incapable of spectral sensitization by themselves or substances substantially incapable of absorbing visible rays and which exhibit the power of supersensitization include condensation products of aromatic organic acid with formaldehyde (e.g., those described in U.S. Pat. No. 3,437,510), cadmium salts, asaindene compounds, aminostilbene compounds substituted by nitrogen-containing heterocyclic groups (e.g., those compounds described in U.S. Pat. Nos. 2,933,390 and 3,635,721). Particularly useful combinations are described in U.S. Pat. Nos. 3,615,613, 3,615,641, 3,617,295 and 3,635,721.

The binder (or protective colloid) advantageously used in the silver halide emulsion of the present invention is gelatin, but other hydrophilic colloids such as gelatin derivatives, graft polymers of gelatin with other polymers, proteins, sugar derivatives, cellulose derivatives, and synthesized hydrophilic high-molecular weight substances such as homo- or copolymers may be used.

The photographic emulsion layers of the photographic material using the silver halide emulsion of the present invention, and other hydrophilic colloidal layers may be hardened with the aid of one or more hardeners that will crosslink the molecule of the binder (or protective colloid) to produce a stronger film. The hardener may be added in an amount sufficient to enable the photographic material to harden to such an extent that there is no need to incorporate any hardener in the processing solution, but if desired, an additional amount of hardener may be present in the processing solution.

A plasticizer may be added to the silver halide emulsion layer(s) and/or other hydrophilic colloidal layer(s) in the light-sensitive material of the present invention in order to enhance their flexibility. Compounds which are preferably used as such plasticizers are described in Research Disclosure (RD) No. 17643, XII, A.

A water-insoluble or slightly water-soluble synthetic polymer dispersion (i.e., latex) may also be incorporated in the photographic emulsion layer(s) and other hydrophilic colloidal layer(s) in the light-sensitive material of the present invention in order to improve the dimensional stability of these layers.

The emulsion layers in the photographic material of the present invention contain a dye forming coupler that will, in color development, enter into coupling with the oxidized product of an aromatic primary amino developing agent (e.g., p-phenylenediamine derivative or aminophenol derivative) to form a dye. A suitable dye forming coupler usually is selected for each emulsion layer so that it will form a dye that absorbs light in the spectral range of sensitivity for each emulsion layers; a yellow dye forming coupler is used in a blue-sensitive emulsion layer; a magenta dye forming coupler is used in a green-sensitive emulsion layer; and a cyan dye forming coupler is used in a red-sensitive emulsion layer. Other combinations of coupler and emulsion may be employed if such are needed for particular silver halide color photographic materials.

The aforementioned dye forming couplers desirably contain in their molecules a ballast group of 8 or more carbon atoms that will render the couplers non-diffusible. These dye forming couplers may be of the four-equivalent type that requires the reduction of four silver ions for the formation of one molecule of a dye, or of the two-equivalent type that needs the reduction of two silver ions. The dye forming couplers include a compound that will, upon coupling with the oxidized product of a developing agent, release a photographically useful fragment such as a development restrainer, development accelerator, bleach accelerator, developing agent, silver halide solvent, tone conditioner, hardener, fogging agent, antifoggant, chemical sensitizer, spectral sensitizer or desensitizer.

Among these compounds are DIR compounds which release a development retarder as a function of development to improve the sharpness or granularity of image. The DIR coupler may be replaced by a DIR compound that will couple with the oxidized product of a developing agent not only to form a colorless compound but also to release a development retarder.

Two types of DIR coupler and DIR compound are usable: one is of the type wherein a retarder is directly bonded to the coupling site, and the other is referred to as a timing DIR coupler or a timing DIR compound wherein the retarder is bonded to the coupling site by a divalent group in such a manner that said retarder will be released as by intramolecular nucleophilic or electron transfer reaction within the group that leaves upon coupling reaction. A retarder that becomes diffusible upon leaving and one that is not highly diffusible may be used either singly or in combination depending on the need. They may also be used in combination with a competing coupler, or a colorless coupler that couples with the oxidized product of an aromatic primary amino developing agent but which will not form any dye.

Known acyl acetanilide based couplers may preferably be used as yellow dye forming couplers in the present invention. Benzoyl acetanilide and pivaloyl acetanilide based compounds are advantageous.

A particularly preferable yellow-dye forming coupler is selected from among the benzoyl-type couplers represented by the following general formula (Y):

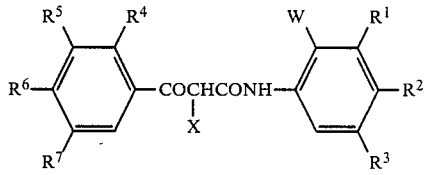

(Y)

In formula (Y), $R^1$, $R^2$ and $R^3$ may be the same or different and each represents a hydrogen atom, a halogen atom (e.g., fluorine, chlorine or bromine), an alkyl group (e.g., methyl, ethyl, allyl or dodecyl), an aryl group (e.g., phenyl or naphthyl), an alkoxy group (e.g., methoxy, ethoxy or dodecyloxy), an acylamino group [e.g., acetamido or α-(p-dodecyloxyphenoxy)-butanamido], a carbamoyl [e.g., carbamoyl, N,N-dimethylcarbamoyl, N-δ-(2,4-di-tert-amylphenoxy) or butylcarbamoyl], an alkoxycarbonyl group [e.g., ethoxycarbonyl, dodecyloxycarbonyl or α-(dodecyloxycarbonyl-)ethoxycarbonyl group), a sulfonamido group (e.g., methanesulfonamido, p-dodecyloxybenzenesulfonamido or N-benzyldodecanesulfonamido), or a sulfamoyl group [e.g., sulfamoyl, N-methylsulfamoyl, N-67-(2,4-di-tert-aminophenoxy)butylsulfamoyl or N,N-diethylsulfamoyl].

In formula (Y), $R^4$, $R^5$, $R^6$ and $R^7$ may be the same or different and each represents a hydrogen atom, an alkyl group (e.g., methyl, ethyl or tert-butyl), an alkoxy group (e.g., methoxy, ethoxy, propoxy or octoxy), an aryloxy group (e.g., phenoxymethylphenoxy), an acylamino group (e.g., acetamido, α-(2,4-di-tert-amylphenoxy)butanamido) or a sulfonamido group (e.g., methanesulfonamido, p-dodecylbenzenesulfonamido or N-benzyldodecanesulfonamido).

In formula (Y), W signifies a halogen atom (e.g., fluorine, chlorine or bromine), an alkyl group (e.g., methyl, ethyl or tert-butyl), an alkoxy group (e.g., methoxy, ethoxy, propoxy or octoxy), an aryloxy group (e.g., phenoxy or methylphenoxy) or a dialkylamino group (e.g., dimethylamino or N-butyl-N-octylamino).

In formula (Y), X signifies a hydrogen atom or a group that can be eliminated and a preferable example of the latter is represented by the general formula (Y'):

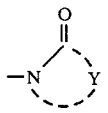

(Y')

where Y signifies the group of nonmetallic atoms that is necessary to form a 5- or 6-membered ring (illustrative cyclic compounds formed by Y are derivatives of 2,5-dioxoimidazoline, 2,5-pyrrolidinedione, 1,3-isoindoledione, 2,3,5-trioxo-imidazolidine, 2,5-dioxo-triazolidine, 2,4-oxazolidinedione, 2,4-thiazolidinedione, 2(1H)-pyridone, 2(1H)-pyrimidone, 2(1H)-pyrazone, 5(1H)-imidazolone, 5(1H)-triazolone, 2(1H)-pyrimidone, 2-pyrazolone(5), 2-isothiazolone(5), 2(1H)-quinaoxazolone, 4(3H)-pyrimidone, 2-benzoxazolone, 4-isoxazolone(5), 3-fluorone(2), 4-imidazolone(2), 3-pyrazolone, 2-tetrazolone(5), 3-tetrazolone(5), etc.)

Specific examples of the yellow couplers represented by formula (Y) are listed below.

[Y-1]

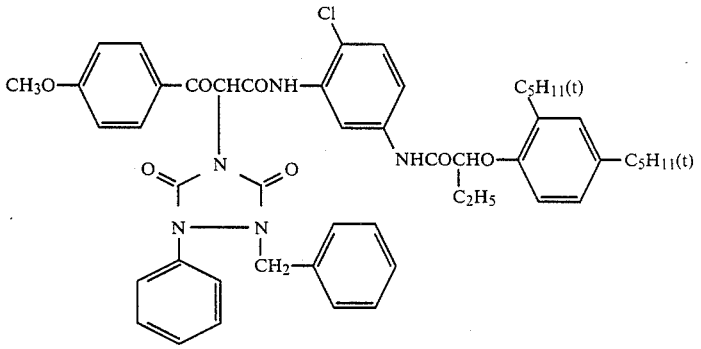

[Y-2]

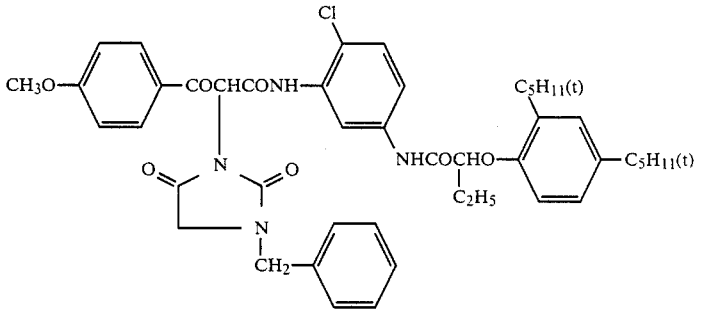

[Y-3]

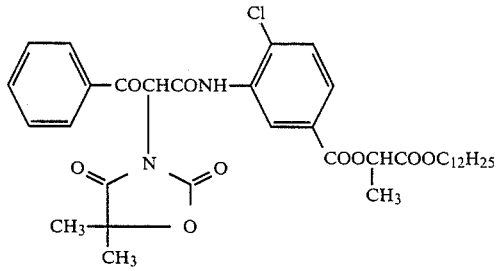

[Y-4]

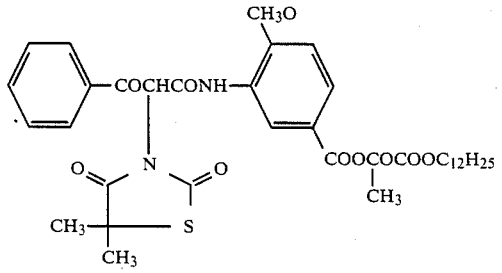

-continued
[Y-5]
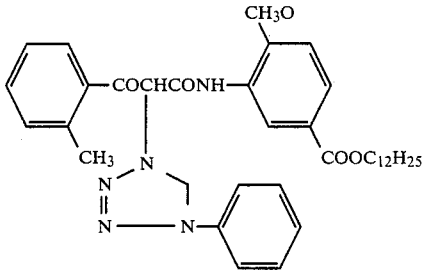
[Y-6]
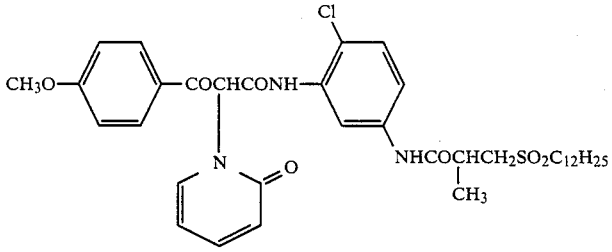
[Y-7]
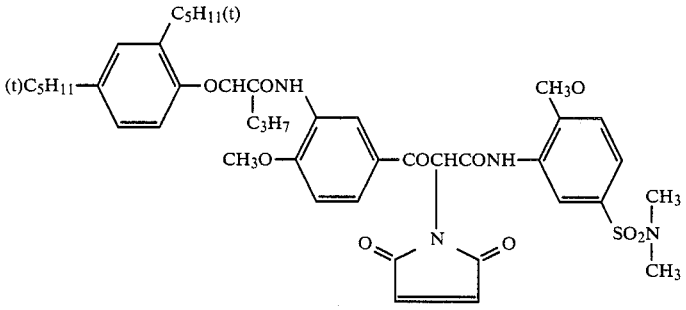
[Y-8]
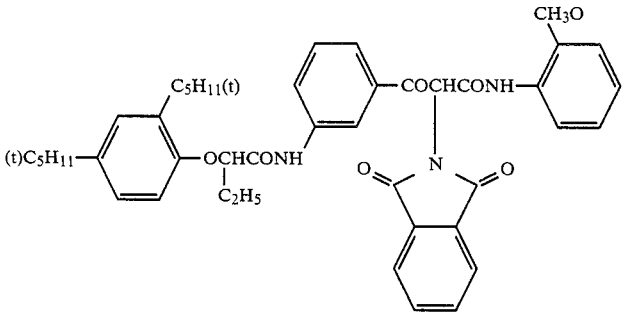
[Y-9]
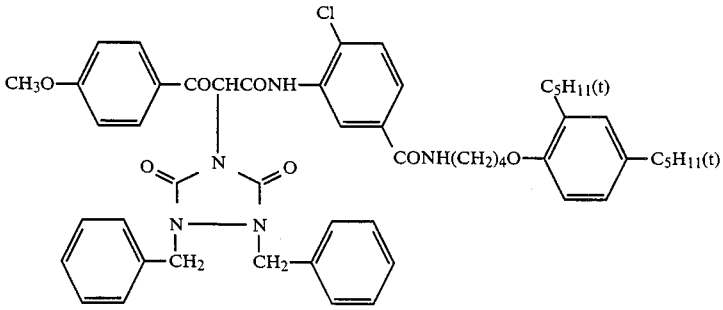

-continued
[Y-10]
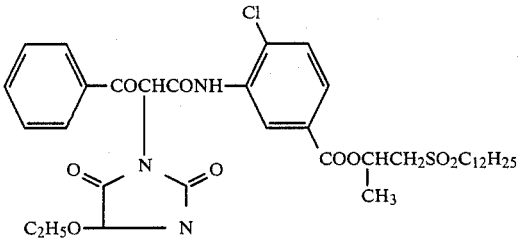
[Y-11]
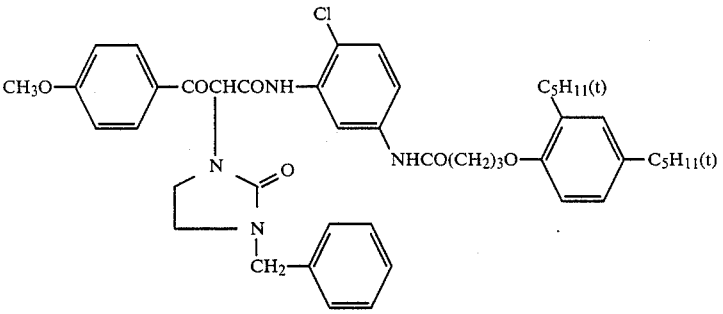
[Y-12]
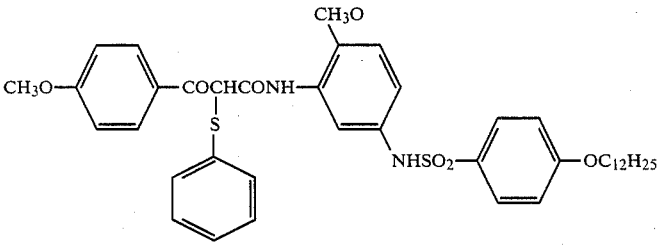
[Y-13]
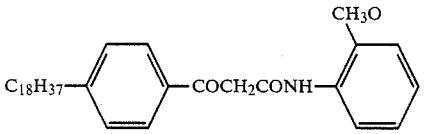
[Y-14]
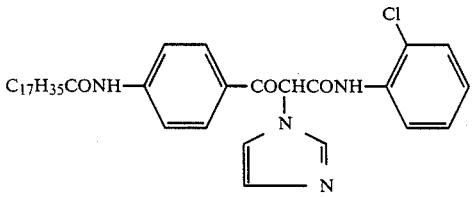
[Y-15]
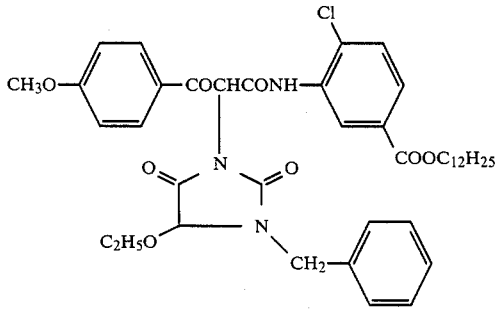

-continued

[Y-16]

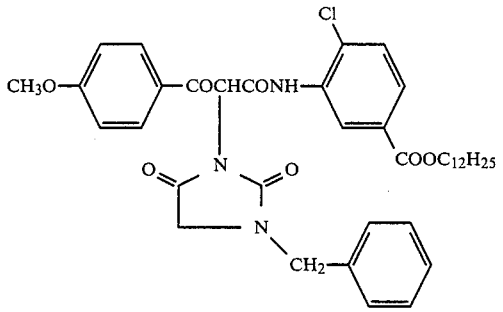

Useful magenta-dye forming couplers are 5-pyrazolone based couplers, pyrazolobenzimidazole based couplers, open-chain acylacetonitrile based couplers, and indazolone based couplers. Particularly preferable magenta couplers are pyrazoloazole compounds represented by the following general formulas (M-1) and (M-2):

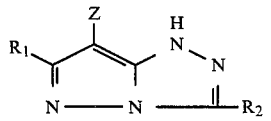

(M-1)

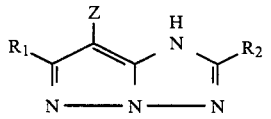

(M-2)

In formulas (M-1) and (M-2), $R_1$ and $R_2$ each represents an alkyl group, an aryl group, or a heterocyclic group, each of which may be bonded to the carbon atom of the nucleus through a bonding group selected from among an oxygen atom, a nitrogen atom and a sulfur atom. Said alkyl, aryl and heterocyclic groups each may be bonded through any of the following bonding groups: acylamino, carbamoyl, sulfonamido, sulfamoylcarbonyl, carbonyloxy, oxycarbonyl, ureido, thioureido, thioamido, sulfone and sulfonyloxy groups.

The group represented by $R_1$ and $R_2$ is straight- or branched-chain alkyl group having 1 to 20 carbon atoms (e.g., methyl, ethyl, propyl, i-propyl, sec-butyl, n-butyl, t-butyl, n-octyl, t-octyl, dodecyl or octadecyl). These groups may have a substituent(s) such as halogen atom, nitro, cyano, alkoxy, aryloxy, amino, acylamino, carbamoyl, sulfonamido, sulfamoyl, imido, alkylthio, arylthio, aryl, alkoxycarbonyl or acyl. Examples of such substituent include chloromethyl, bromomethyl, trichloromethyl, β-nitroethyl, δ-cyanobutyl, methoxymethyl, ethoxyethyl, phenoxyethyl, N-methylaminoethyl, dimethylaminobutyl, acetoaminoethyl, benzoylamino, propyl, ethylcarbamoylethyl, methanesulfonamidoethyl, ethylthioethyl, p-methoxyphenylthiomethyl, phenylmethyl, p-chlorophenylmethyl, naphthylethyl, ethoxycarbonylethyl and acetylethyl.

Preferable aryl groups are phenyl and naphthyl groups, which may have such a substituent(s) as shown with respect to the alkyl group.

The heterocyclic ring represented by $R_1$ or $R_2$ is preferably a 5- or 6-membered ring having at least one of the nitrogen, oxygen and sulfur atoms, and it may be one having or not having aromaticity. Examples of such ring include pyridyl, quinolyl, pyrrolyl, morpholyl, furanyl, tetrahydrofuranyl, pyrazolyl, triazolyl, tetrazolyl, thiazolyl, oxazolyl, imidazolyl and thiadiazolyl. These may also have such a substituent(s) as shown with respect to the alkyl group.

Examples of the alkyl, aryl or heterocyclic group represented by $R_1$ or $R_2$ which is bonded through one of the bonding groups mentioned above or through a nitrogen, oxygen or sulfur atom are shown below:

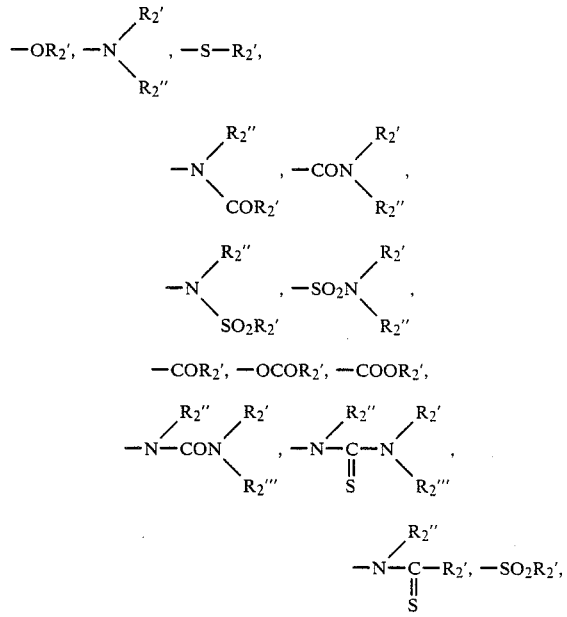

wherein $R_2'$ represents an alkyl, aryl or heterocyclic group; and $R_2''$ and $R_2'''$ each represents a hydrogen atom, an alkyl group, an aryl group or a heterocyclic ring.

If the heterocyclic group is a pyrazolotriazole based compound, a bis type pyrazolotriazole based compound is formed and this is of course a magenta coupler included within the scope of the present invention.

Shown below are specific examples of $R_1$ and $R_2$ in formulas (M-1) and (M-2):

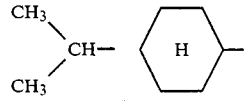

-continued
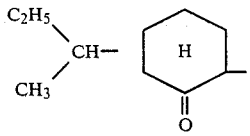
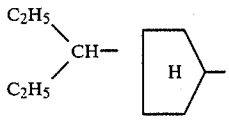
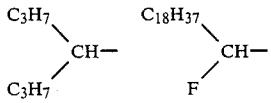
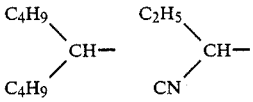
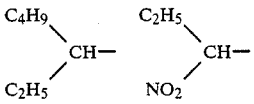
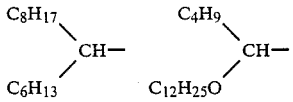
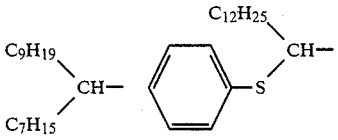
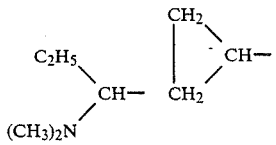
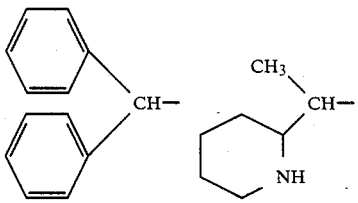
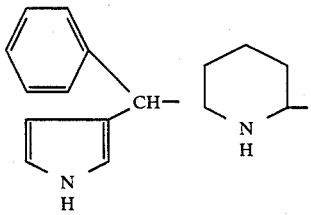
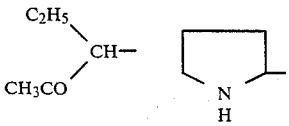
-continued
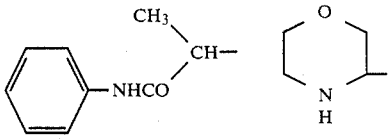
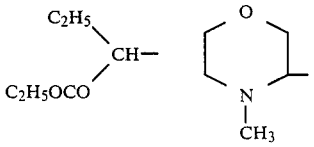
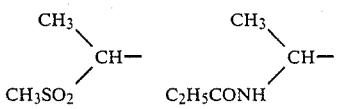
$CH_3-$ $C_2H_5-$ $(n)C_3H_7-$ $(n)C_8H_{17}-$ $(n)C_{15}H_{31}-$
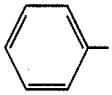
$(t)C_4H_9-$ $(t)C_5H_{11}-$ $(t)C_8H_{17}-$
$-C_{17}H_{35}$ $-CH_2CH_2CH_2OC_{12}H_{25}$ $-CH_2CH_2CONHC_{14}H_{29}$
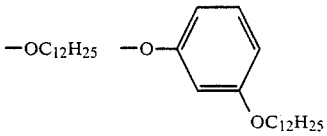
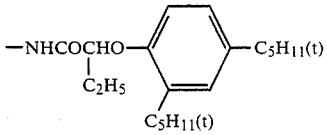
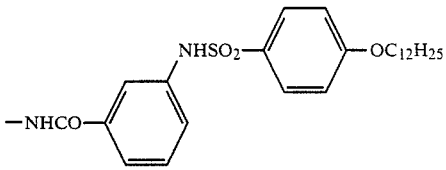
$-NHC_{14}H_{29}$ $-N(CH_2CHC_4H_9)_2$
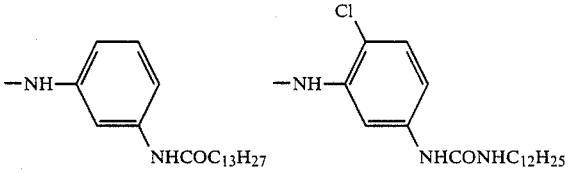
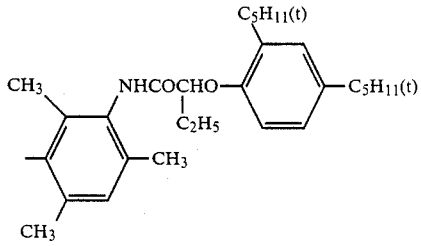

-continued $-S-C_{16}H_{33}$ $-CONHC_{14}H_{29}$ $-NHSO_2C_{16}H_{33}$ $-SO_2NHC_{16}H_{33}$ $-COC_{11}H_{23}$ $-OCOC_{15}H_{31}$

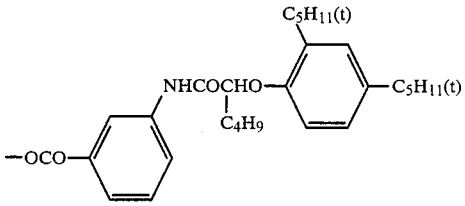

$-COOC_{12}H_{25}$ $-NHCONH-$ 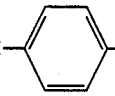 $-SO_2C_{12}H_{25}$ $-SO_2C_{16}H_{33}$ $-OSO_2-$ 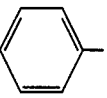 $-C_8H_{17}(t)$

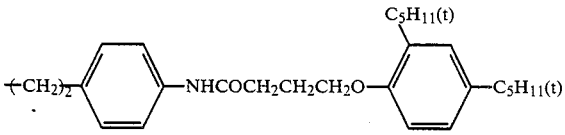

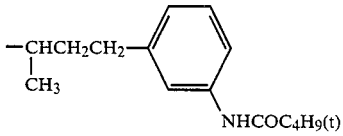

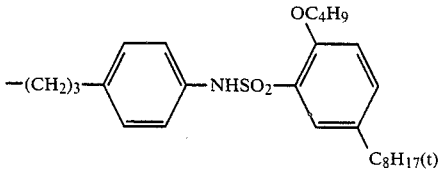

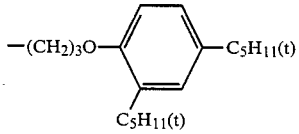

Z represents a hydrogen atom or a group which leaves upon formation of a dye through coupling with the oxidized product of an aromatic primary amine color developing agent.

A group represented by Z that leaves upon formation of a dye through coupling with the oxidized product of an aromatic primary amine color developing agent includes, for example, an halogen atom, an alkoxy group, an aryloxy group, an acyloxy group, an arylthio group, an alkylthio group and

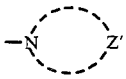

(where Z' represents a group of the atoms necessary for forming a 5- or 6-membered ring together with a nitrogen atom and an atom selected from a carbon atom, a oxygen atom, a nitrogen atom and a sulfur atom).

Illustrative leaving groups are as follows.

An halogen atom: chlorine, bromine or fluorine atom,

An alkoxy group: ethoxy, benzyloxy, methoxyethylcarbamoylmethoxy or tetradecylcarbamoylmethoxy group, An aryloxy group: phenoxy, 4-methoxyphenoxy or 4-nitrophenoxy group, An acyloxy group: acetoxy, myristoyloxy or benzoyloxy group, An arylthio group: phenylthio, 2-buthoxy-5-octylphenylthio or 2,5-dihexyloxyphenylthio group, An alkylthio group: methylthio, octylthio, hexadecylthio, benzylthio, 2-(diethylamino)ethylthio, ethoxyethylthio or phenoxyethylthio group, and

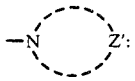

pyrazolyl, imidazolyl, triazolyl or tetrazolyl group.

Illustrative a group represented by

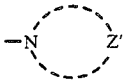

includes as follows.

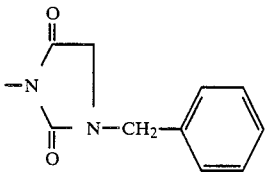

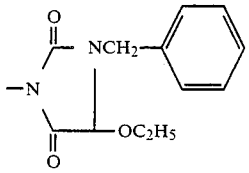

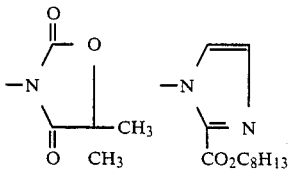

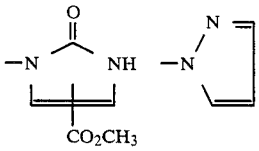

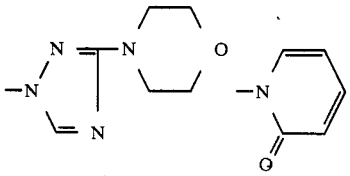

-continued
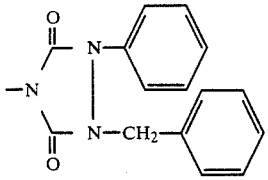
-continued
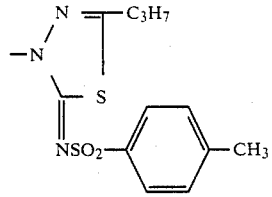
The following are non-limiting examples of the pyrazolotriazole type magenta couplers that are prefereably used in the present invention.
1
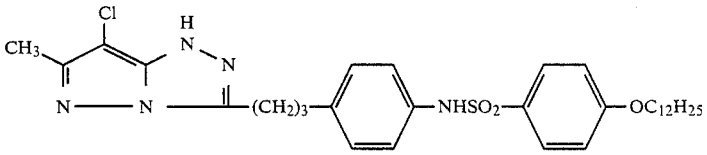
2
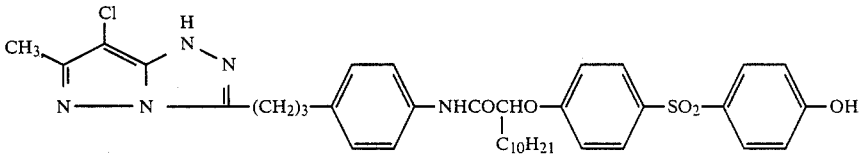
3
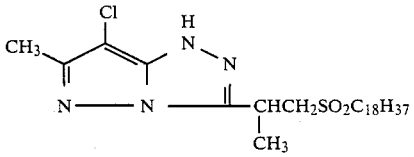
4
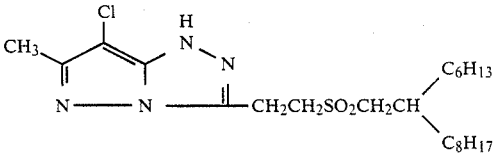
5
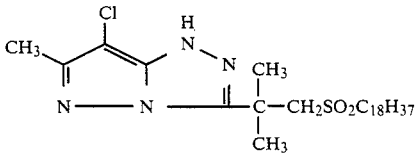
6
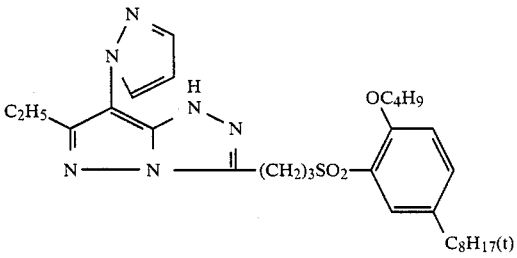
7
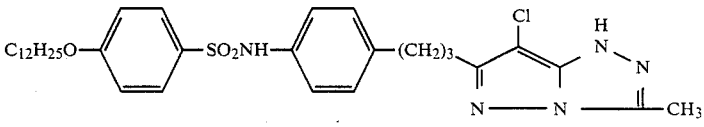

-continued
8
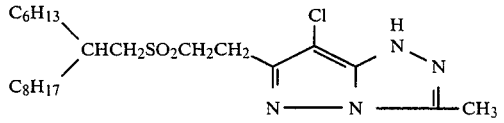
9
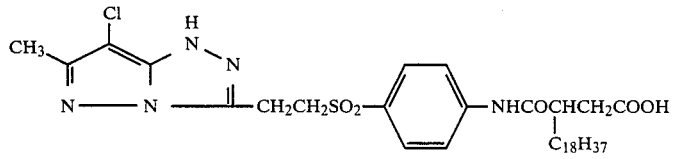
10
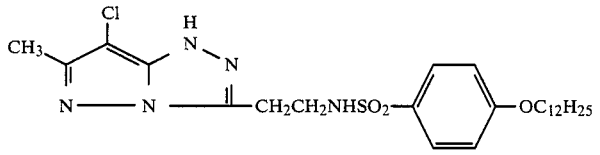
11
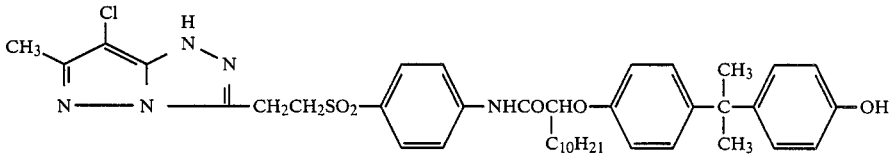
12
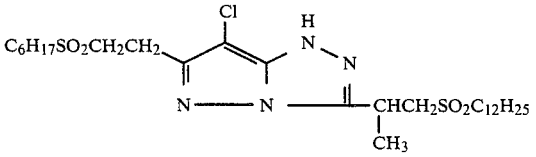
13
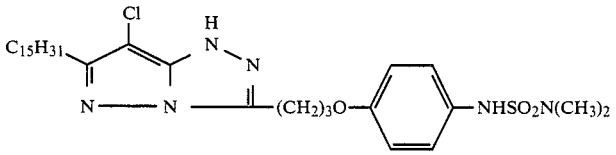
14
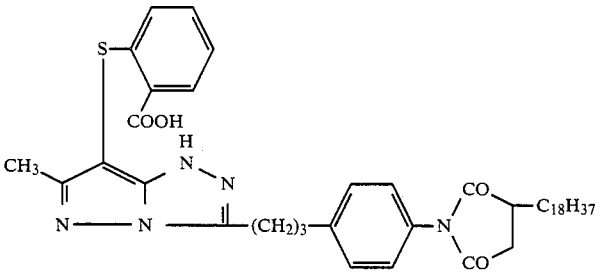
15
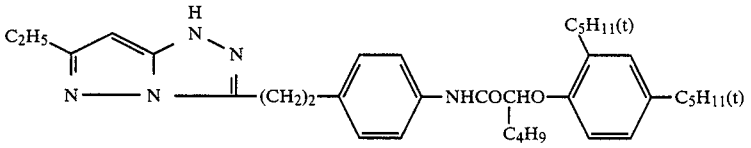
16
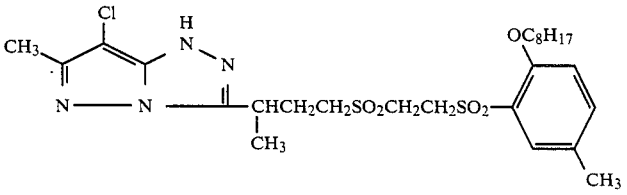

-continued
17
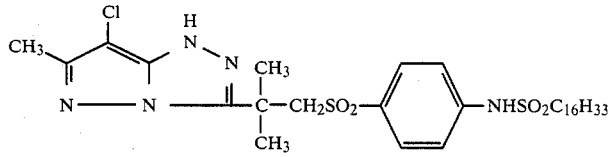
18
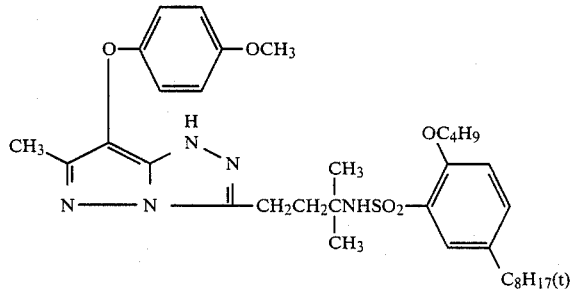
19
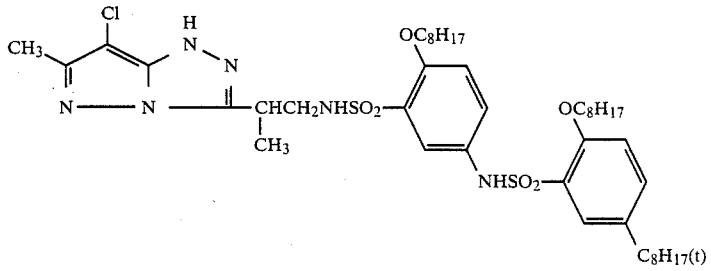
20
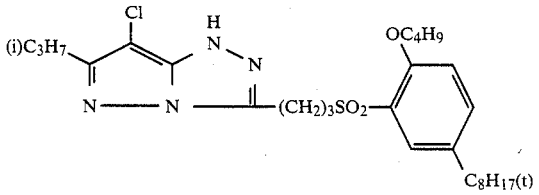
21
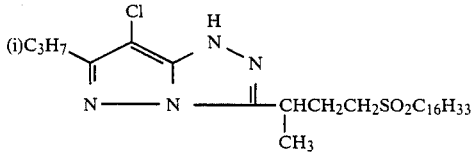
22
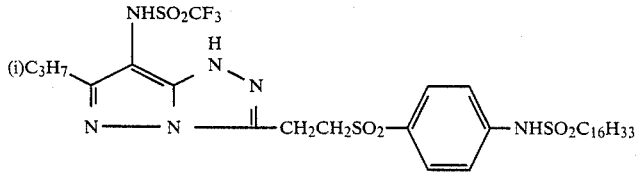
23
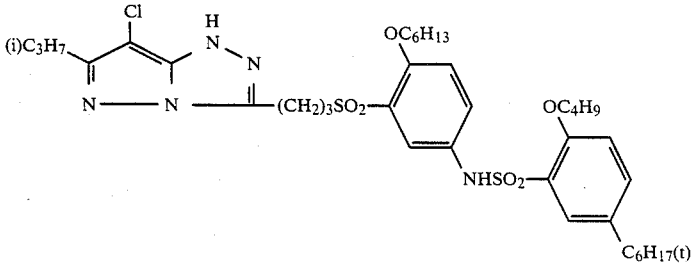

-continued

24

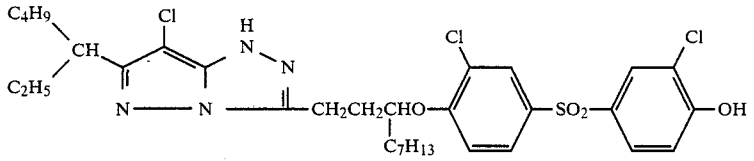

(t) 25

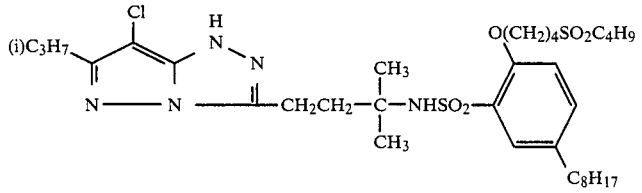

26

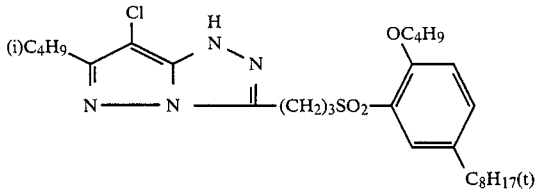

27

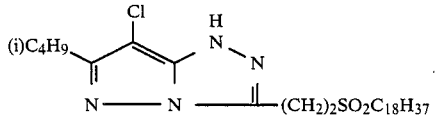

28

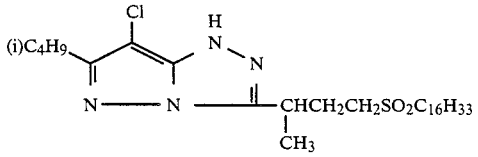

29

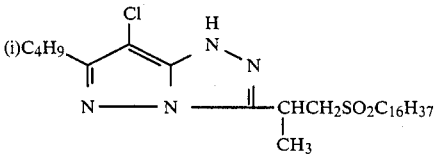

30

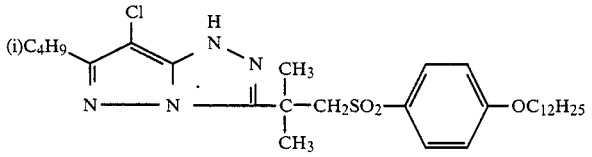

Photographic additives such as dye-forming couplers, DIR couplers, DIR compounds, image stabilizers, color fog preventing agents, uv absorbing agents and brighteners do not need to be absorbed onto the surfaces of silver halide grains. Among these additives, those which are hydrophobic may be dispersed by various methods such as the solid dispersion method, the latex dispersion method, and the oil-in-water type emulsion dispersion method. An appropriate dispersion method may be selected in accordance with such factors as the chemical structure of the specific hydrophobic compound such as a coupler. The oil-in-water type emulsion method may be implemented by any conventional method of dispersing hydrophobic additives such as couplers, which usually comprises dissolving such hydrophobic additives in a high-boiling organic solvent having a boiling point not lower than about 150° C., optionally together with a low-boiling solvent and/or a water-soluble organic solvent, then emulsion-dispersing the dissolved hydrophobic additives with the aid of a surfactant in a hydrophilic binder such as an aqueous gelatin solution by means of such dispersing devices as a stirrer, homogenizer, colloid mill, flow-jet mixer or ultrasonic disperser, and thereafter adding the resulting dispersion into the hydrophilic colloidal fluid of interest. In that case, the step of removing the low-boiling organic solvent after or simultaneously with dispersion may be added.

The high-boiling organic solvent is one having a boiling point not lower than 150° C. that does not react with the oxidized product of a developing agent, such as a phenol derivative, an alkyl phthalate ester, a phosphate ester, a citrate ester, a benzoate ester, an alkylamide, a fatty acid ester or a trimesic acid ester.

Low-boiling solvents or water-soluble organic solvents may be used together with, or instead of high-boiling solvents. Illustrative low-boiling organic solvents that are substantially water-insoluble include ethyl acetate, propyl acetate, butyl acetate, butanol, chloroform, carbon tetrachloride, nitromethane, nitroethane and benzene. Exemplary water-soluble organic solvents include: acetone, methyl isobutyl ketone, β-ethoxyethyl acetate, methoxyglycol acetate, methanol, ethanol, acetonitrile, dioxane, dimethylformamide, dimethyl sulfoxide, hexamethyl phosphoric triamide, diethylene glycol monophenyl ether and phenoxyethanol.

If photographic additives such as dye forming couplers, DIR couplers, DIR compounds, image stabilizers, color fog preventing agents, uv absorbers and brighteners have acid groups such as carboxylic acid group or a sulfonic acid group, these additives may be incorporated in hydrophilic colloids in the form of aqueous alkaline solutions.

Dispersion aids may be used in dissolving hydrophobic compounds in low-boiling solvents, used either alone or in mixture with high-boiling solvents, then dispersing the dissolved hydrophobic compounds into water either mechanically or by means of ultrasonic waves, and suitable dispersion aids include anionic surfactants, nonionic surfactants, cationic surfactants and amphoteric surfactants.

The oxidation product of a developing agent or an electron transfer agent may migrate between emulsion layers in the light-sensitive layer (i.e., between layers which are sensitive to the same color and/or between layers which are sensitive to different colors) so as to cause color contamination, deteriorated image sharpness or pronounced graininess. In order to avoid these problems, color fog preventing agents may be employed. Such color fog preventing agents may be incorporated in emulsion layers per se. Alternatively, they may be incorporated in an intermediate layer disposed between adjacent emulsion layers. Preferable color fog preventing agents are hydroquinone derivatives, aminophenol derivatives, gallic acid derivatives, and ascorbic acid derivatives.

In a preferable embodiment, the silver halide photographic material that uses silver halide grains with a AgI content of 3.0–15 mol % and the compound of the present invention represented by formula (I) also employs a DP′ scavenger, or a compound that will react with the oxidized product of a color developing agent as a function of the development of silver halide emulsion layers but which will not contribute to image formation. When conventional anti-foggants are used in combination with DP′ scavengers, the photographic performance characteristics have a tendency to be deteriorated as manifested by reduced sensitivity. However, in the preferred embodiment of the present invention described above, not only the storage stability but also image graininess of the light-sensitive material can be improved without causing any deterioration of other aspects of its photographic performance.

The DP′ scavenger that is preferably used in the present invention is described hereinafter. Preferable examples of such DP′ scavenger include hydroquinone compounds represented by the general formula (H) shown below, pyrogallol, catechol and resorcin compounds represented by the general formula (P) shown below, sulfonylamino compounds represented by the general formula (S) shown below, and coupling-type compounds represented by the general formula (C) shown below.

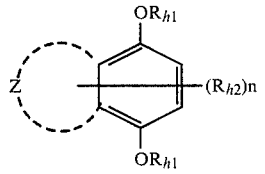

(H)

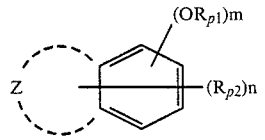

(P)

where Rh1 and Rp1 which may be the same or different each represents hydrogen atom, an aliphatic group or an acyl group; m in formula (P) is 2 or 3, provided that when m=2, the two —ORp1 are at ortho or meta position, and that when m=3, the three —ORp1 are bonded to each other at adjacent sites; Rh2 and Rp2 which may be the same or different each represents a monovalent group; n is an integer of 0–6; . . . Z . . . represents a naphthalene ring that may be formed together with the benzene ring.

The aliphatic group represented by Rh1 or Rp1 may have a substituent and is illustrated by an alkyl group or an alkenyl group. The acyl group represented by Rh1 or Rp1 is illustrated by an alkylcarbonyl or arylcarbonyl group.

Examples of the monovalent group represented by Rh2 or Rp2 include: a halogen atom, an aliphatic group, a cycloalkyl group, an aromatic group, an alkylthio group, a carbamoyl group, a cyano group, a formyl group, an aryloxy group, an acyloxy group, a carboxyl group or a salt thereof, a sulfo group or a salt thereof, an alkoxycarbonyl group, a cycloalkoxycarbonyl group, an aryloxycarbonyl group, CORh3, CORp3, $SO_2$Rh4, $SO_2$Rp4, CONHRh5, CONHRp5, NHCORh6, and NHCORp6, wherein Rh3, Rp3, Rh4, Rp4, Rh5, Rp5, Rh6 and Rp6 each represents an aliphatic group, an aromatic group or a heterocyclic group.

Typical examples of the compounds represented by the general formula (H) are listed below.

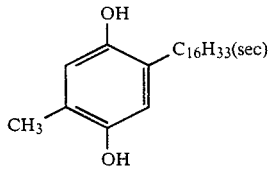

H-1

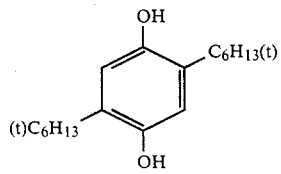

H-2

-continued

H-3

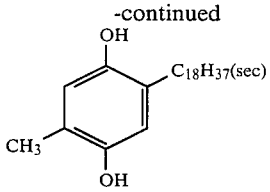

H-4

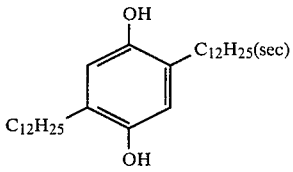

H-5

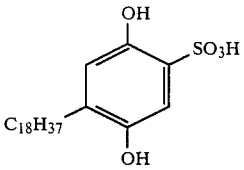

H-6

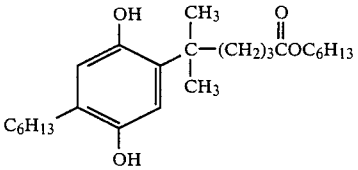

-continued

H-7

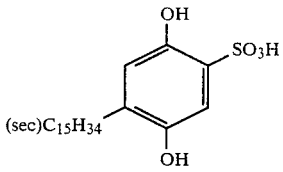

H-8

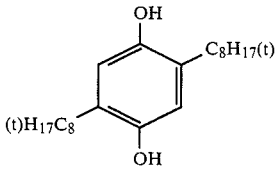

H-9

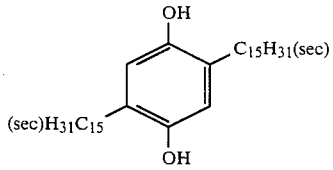

Typical examples of the compounds represented by the general formula (P) are listed in the following tables.

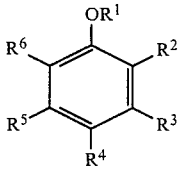

| compounds | $R^1$ | $R^2$ | $R^3$ | $R^4$ | $R^5$ | $R^6$ |
|---|---|---|---|---|---|---|
| P-1 | —H | —OH | —H | —$C_4H_9$(t) | —H | —H |
| P-2 | —H | —OH | —H | 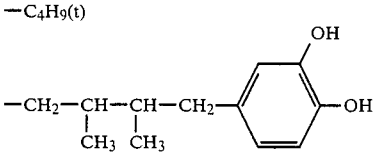 | —H | —H |
| P-3 | —H | —OH | —H | —H | —$C_8H_{17}$(t) | —H |
| P-4 | —H | —H | —OH | —$SO_3NH_4$ | —H | —H |
| P-5 | —H | —H | —OH | —$C_8H_{17}$ | —H | —H |
| P-6 | —H | —OH | —H | —$COOC_{12}H_{25}$ | —H | —OH |
| P-7 | —H | —OH | —H | —$COOC_3H_7$(iso) | —H | —OH |
| P-8 | —H | —OH | —H | —$CONHC_{12}H_{25}$ | —H | —OH |
| P-9 | —H | —OH | —H | —$CONH(CH_2)_3OC_{18}H_{37}$ | —H | —OH |
| P-10 | —H | —$OCH_3$ | —H | —COOH | —H | —$OCH_3$ |
| P-11 | —H | —$OCH_3$ | —H | —$COOC_{12}H_{25}$ | —H | —$OCH_3$ |

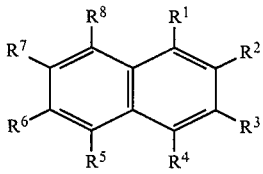

| compounds | $R^1$ | $R^2$ | $R^3$ | $R^4$ | $R^5$ | $R^6$ | $R^7$ | $R^8$ |
|---|---|---|---|---|---|---|---|---|
| P-12 | —OH | —OH | —$C_2H_5$ | —H | —H | —H | —H | |
| P-13 | —OH | —OH | —H | —$C_4H_9$(t) | —H | —H | —H | —H |
| P-14 | —OH | —OH | —H | —H | —H | —$CH_3$ | —H | —H |
| P-15 | —OH | —OH | —H | —H | —H | —H | —$C_{12}H_{25}$ | —H |

-continued

| | | | | | | | | |
|---|---|---|---|---|---|---|---|---|
| P-16 | —OH | —OH | —H | —H | —H | —H | —H | $—C_2H_5$ |
| P-17 | $—C_4H_9(t)$ | —OH | —OH | —H | —H | —H | —H | —H |
| P-18 | —H | —OH | —OH | —H | $—CH_3$ | —H | —H | —H |
| P-19 | —H | —OH | —OH | —H | —H | —H | $—C_8H_{17}$ | —H |
| P-20 | —OH | $—C_5H_{11}$ | —OH | —H | —H | —H | —H | —H |
| P-21 | —OH | —H | —OH | $—CH_3$ | —H | —H | —H | —H |
| P-22 | —OH | —H | —OH | $—C_4H_9(t)$ | —H | —H | —H | —H |

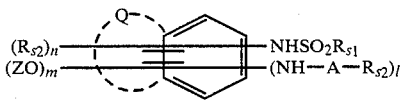

(S)

where A represents —CO— or $—SO_2—$; Rs1 and Rs2 each represents an alkyl group, an aryl group, a heterocyclic group or an amino group; Z represents a hydrogen atom or an alkali decomposable precursor group; l is 1 or 2, provided that when l=2, the two NH—A—Rs2 may be the same or different; m is 0 or 1; at least one of —NH—A—Rs2 and —OZ is bonded on the position ortho or para with respect to $—NHSO_2Rs1$; Rs2 is a substituent; n is 0–6 provided that when n is 2–6, the Rs2 may be the same or different; and . . . Q . . . represents a naphthalene ring that may be formed together with the benzene ring.

In formula (S), the alkyl group represented by Rs1 or Rs2 may be straight-chained or branched and preferably has 1–30 carbon atoms. The aryl group represented by Rs1 or Rs2 preferably has 6–30 carbon atoms. The heterocyclic group represented by Rs1 or Rs2 is preferably one having 5–30 carbon atoms and at least one of oxygen and nitrogen as hetero atoms. The amino group represented by Rs1 or Rs2 may be substituted by an alkyl or aryl group.

In the alkali decomposable precursor group represented by Z, the hydrogen atom in the hydroxyl group is substituted by a blocking group which is eliminated upon contact with an alkali. A typical blocking group is one that can be eliminated by hydrolysis or intermolecular nucleophilic substitution. A typical example of the group that can be eliminated by hydrolysis is an acyl group such as an aliphatic or aromatic carbonyl or sulfonyl group. Typical examples of the group that can be eliminated by intermolecular nucleophilic substitution are described in U.S. Pat. No. 4,310,612.

The group represented by Rs2 may have a substituent.

The compounds represented by the general formula (S) can be synthesized by any known methods with reference being made to such prior patents as Japanese Patent Application (OPI) Nos. 5247/1984, 192247/1984, 195238/1984, 195239/1984, 204040/1984, 108843/1985 and 118836/1985.

Specific examples of the DP′ scavenger of the sulfonylamino compound type are listed below.

S-1

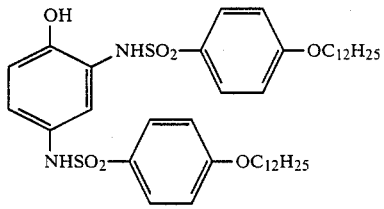

S-2

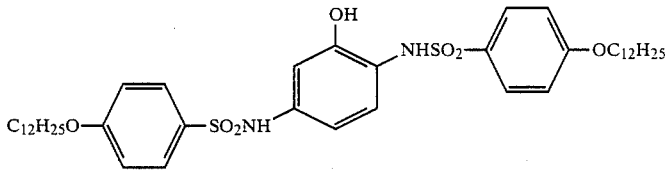

S-3

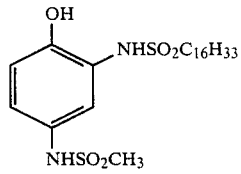

S-4

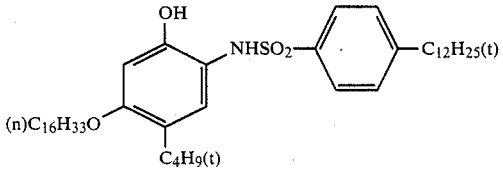

-continued
S-5
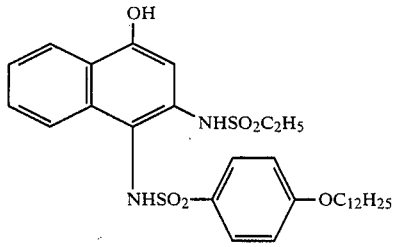
S-6
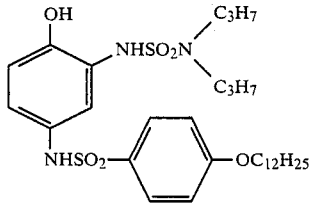
S-7
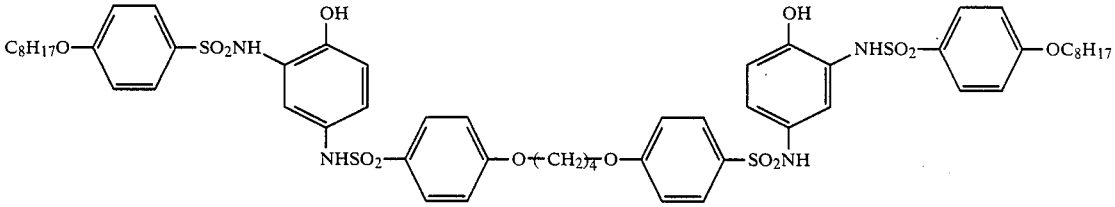
S-8
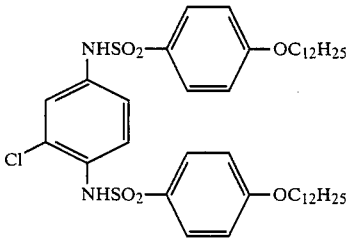
S-9
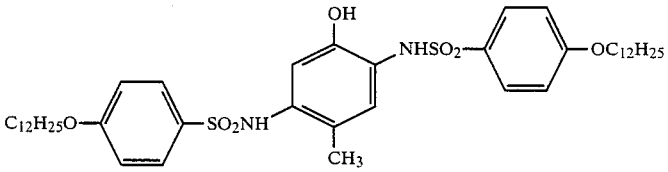
S-10
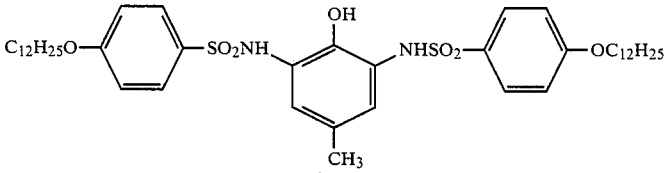
S-11
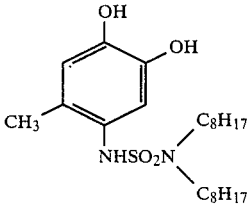

-continued
S-12
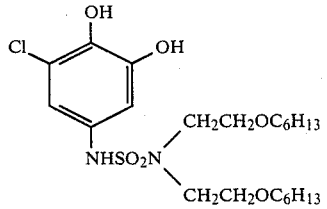
S-13
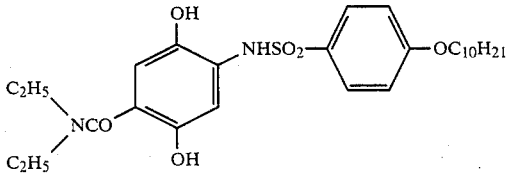
S-14
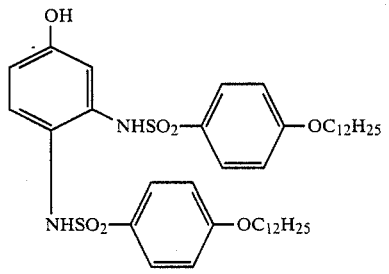
S-15
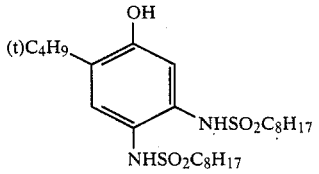
S-16
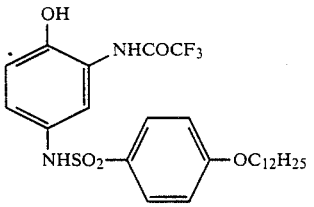
S-17
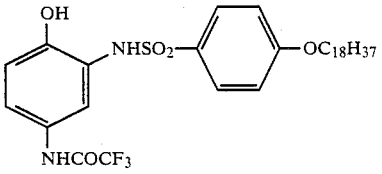
S-18
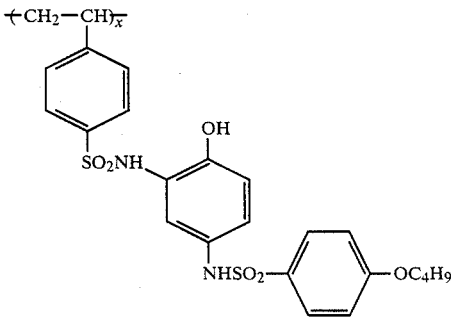
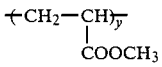
x:y = 53:47

-continued

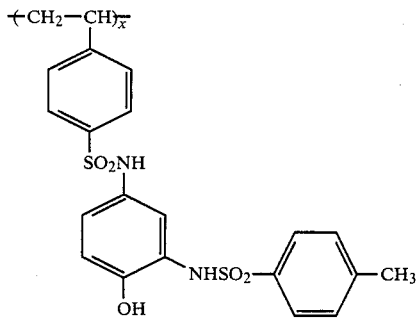

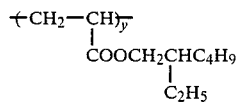

x:y = 65:35

S-19

The coupling-type DP′ scavenger represented by the general formula (C) may be classified as follows:

(1) a coupler that couples with the oxidized product of a color developing agent to form a dye that is liberated into a processing fluid;

(2) a coupler that couples with the oxidized product of a color developing agent but which remains in the system as a leuco form; and (3) a coupler that couples with the oxidized product of a color developing agent to form a dye that does not have a pronounced visible absorption but which provides a substantially colorless product.

Accordingly, the general formula (C) is further divided into subgroups of formula (C-i) (i=1,2, . . . , 13), which include DP′ scavengers that are particularly preferable for the purposes of the present invention.

Compounds that belong to group (1) may be represented by the following general formula (C-1):

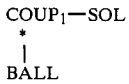

(C-1)

wherein $COUP_1$ signifies a coupler nucleus having a coupling site (indicated by the asterisk); BALL is a group that is bonded to the coupling site of $COUP_1$ and which can be eliminated from $COUP_1$ upon reaction between said $COUP_1$ and the oxidized product of a color developing agent, said BALL being a stabilizing group that has a size and shape which renders the compound of formula (C-1) nondiffusible; and SOL is a solubilizing group that is bonded to the noncoupling site of $COUP_1$ and which impart mobility by which the coupling product formed as a result of coupling between $COUP_1$ and the oxidized product of a color developing agent is dissolved out of the light-sensitive material during or after color development.

The coupler nucleus represented by $COUP_1$ may be any of the coupler nuclei that are either known or used in the photographic field for the purpose of forming a colored or colorless reaction product as a result of coupling with the oxidized product of a color developing agent.

As already mentioned, BALL is a stabilizing group that has a molecular size and shape which renders the compound of formula (C-1) nondiffusible. While any group can be used as BALL so long as it imparts nondiffusibility to the compound of formula (C-1), useful groups include alkyl, aryl and heterocyclic groups having 8–32 carbon atoms. These groups may have a substituent that increases the non-diffusibility of the compound of formula (C-1), alters its reactivity, or which enters into coupling reaction and is eliminated to increase the diffusiblity of BALL. Preferably, BALL is bonded to the coupling site of $COUP_1$ by a linkage.

The solubilizing group represented by SOL is one that imparts mobility by which the coupling product formed as a result of coupling reaction can be dissolved out of the light-sensitive material; illustrative solubilizing groups include ionizable hydroxyl, carboxyl, sulfo and aminosulfonyl groups and ionizable salts thereof, as well as ester groups and ether groups.

Preferably, one or more of these groups may be bonded to the noncoupling site of $COUP_1$. Alternatively, solubilizing groups wherein an alkyl group having 6–10 carbon atoms or an aryl group having 6–12 carbon atoms has one or more of the ionizable groups mentioned above may be bonded to the noncoupling site of $COUP_1$ and such solubilizing groups can also be used with advantage.

Also preferable are the solubilizing groups that are bonded to the noncoupling site of $COUP_1$ by a linkage. Particularly preferable solubilizing groups are: a carboxyl group, a sulfo group or an ionizable salt thereof that are directly bonded to the noncoupling site of $COUP_1$; and an alkyl group having 1–10 carbon atoms or an aryl group having 6–12 carbon atoms that contain one or more carboxyl or sulfo groups or ionizable salts thereof and which are bonded to the noncoupling site of $COUP_1$ either directly or by an amino or carbonyl group.

DP′ scavengers which are more preferably used for the purpose of forming yelllow, magenta or cyan dyes are represented by the following general formulas (C-2 to (C-7).

Yellow-dye forming compounds.

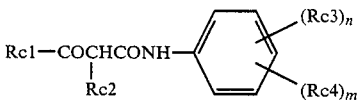

(C-2)

where Rc1 is an aryl group or an alkyl group, in particular, a tertiary alkyl group; Rc2 is a stabilizing group (BALL) as defined above; Rc3 is a solubilizing group (SOL) as defined above; Rc4 is a hydrogen atom, a halogen atom, an alkyl group or an alkoxy group; and $n+m \leqq 5$, provided that Rc3 and Rc4 may be the same or different when $n \neq 0$ and $m \neq 0$ and each of n and m is 2 or more.

Magenta-dye forming compounds:

(C-3)

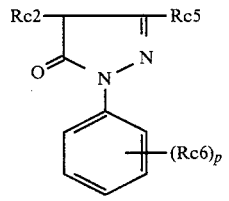

(C-4)

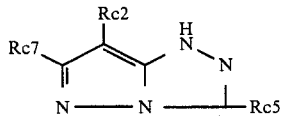

(C-5)

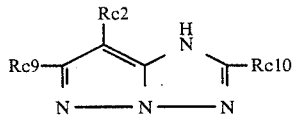

wherein Rc2 is the same as Rc2 in formula (C-2); Rc5 is a solubilizing group (SOL) as defined above; Rc6 is a hydrogen atom, a halogen atom, an alkyl group, an alkoxy group or an amino group; $p \leqq 5$, provided that when $p \neq 0$ and p is 2 or more, Rc6 may be the same or different; one of Rc7 and Rc8 represents a solubilizing group (SOL) as defined above and the other is a hydrogen atom, an alkyl group, an alkoxy group, an aryl group or an amino group; and Rc9 and Rc10 in formula (C-5) are the same as Rc7 and Rc8 in formula (C-4).

Cyan-dye forming compounds:

(C-6)

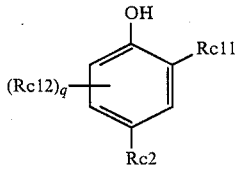

(C-7)

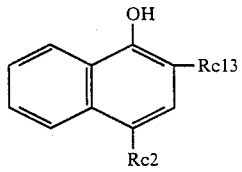

where Rc2 is the same as Rc2 in formula (C-2); at least one of Rc11 and Rc12 is a solubilizing group (SOL) as defined above and the other is a hydrogen atom, a halogen atom, an alkyl group, an alkoxy group or an alkylamido group; $q \leqq 3$ provided that $q \neq 0$; and Rc13 is a solubilizing group (SOL) as defined above.

Unless otherwise noted above, the alkyl group, alkoxy group or alkylamido group each contains 1–8 carbon atoms; the aryl group contains 6–10 carbon atoms, and the amino group may be primary, secondary or tertiary. These substituents and the stabilizing group (BALL) may be further substituted by a halogen atom or such groups as hydroxy, carboxy, amino, amido, carbamoyl, sulfamoyl, sulfonamido, alkyl, alkoxy and aryl.

Compounds of group (2) described above may be represented by the following general formula (C-8):

(C-8)

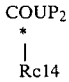

where $COUP_2$ is the same as $COUP_1$ in formula (C-1); and Rc14 is a group that is bonded to the coupling site of $COUP_2$ and which can not be eliminated upon reaction between the coupler of formula (C-8) and the oxidized product of a color developing agent.

The coupler nucleus represented by $COUP_2$ may be exemplified by the coupler nuclei shown in connection with formula (C-1).

The group represented by Rc14 may be exemplified by such groups as alkyl, substituted alkyl, aryl, substituted aryl, alkenyl and cyano.

The compound represented by formula (C-8) is preferably rendered nondiffusible with an alkyl, aryl or heterocyclic group having 8–32 carbon atoms that is bonded to the noncoupling site of $COUP_2$ (coupler nucleus) by a linkage.

Compounds of group (3) described above may be represented by the following general formula (C-9):

(C-9)

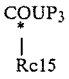

where $COUP_3$ represents a coupler nucleus that provides a substantially colorless product upon coupling reaction with the oxidized product of a color developing agent; and Rc15 is a group that is bonded to the coupling site of $COUP_3$ and which can be eliminated from $COUP_3$ as a result of coupling reaction with the oxidized product of a color developing agent.

More preferable examples of the compound of formula (C-9) may be represented by formulas (C-10) to (C-13):

(C-10)

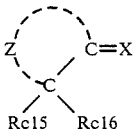

where Rc15 is the same as Rc15 in formula (C-9); Rc16 is a hydrogen atom, an alkyl group, an aryl group, a halogen atom, an alkoxy group, an acyloxy group or a heterocyclic group; X is an oxygen atom or =N—Rc17 (where Rc17 is an alkyl group, an aryl group, a hydroxy group, an alkoxy group or a sulfonyl group); and Z represents the group of nonmetallic atoms that is necessary for forming a 5- to 7-membered ring (e.g., indanone, cyclopentanone or cyclohexanone) or a hetero ring (e.g., piperidone, pyrrolidone or hydrocarbostyryl);

(C-11)

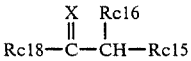

where Rc15, Rc16 and X are the same as Rc15, Rc16 and X in formula (C-10); Rc18 is an alkyl, aryl, heterocyclic, cyano, hydroxy, alkoxy, aryloxy, heterocyclic oxy, alkylamino, dialkylamino or anilino group;

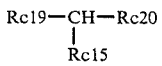

(C-12)

where Rc15 is the same as Rc15 in formula (C-9); Rc19 and Rc20 which may be the same or different each represents an alkoxycarbonyl group, a carbamoyl group, an acyl group, a cyano group, a formyl group, a sulfonyl group, a sulfinyl group, a sulfamoyl group, or

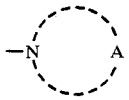

(where A represents the group of nonmetallic atoms necessary to form a 5- to 7-membered ring such as phthalimido, triazole or tetrazole together with the nitrogen atom); and

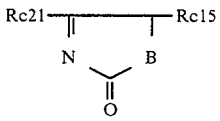

(C-13)

where Rc15 is the same as Rc15 in formula (C-9); Rc21 represents an alkyl group, an aryl group, an anilino group, an alkylamino group, or an alkoxy group; and B represents an oxygen, sulfur or nitrogen atom.

The compounds represented by formulas (C-1) to (C-13) can be synthesized by the methods described in Japanese Patent application (OPI) Nos. 113440/1984, 171955/1984 and 82423/1977; British Patent Nos. 914,145 and 1,284,649; and U.S. Pat. Nos. 2,743,832, 3,227,550, 3,928,041, 3,958,993, 3,961,959, 4,046,574, 4,052,213 and 4,149,886.

Typical, but by no means limiting, examples of the DP' scavenger of the coupling type are listed below.

Compounds of group (1)

C-1

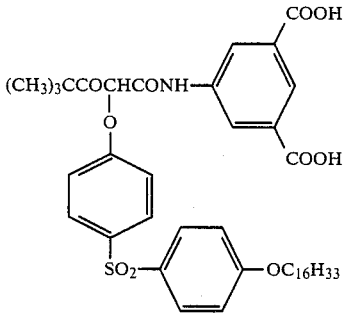

C-2

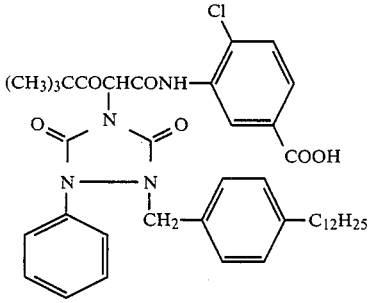

C-3

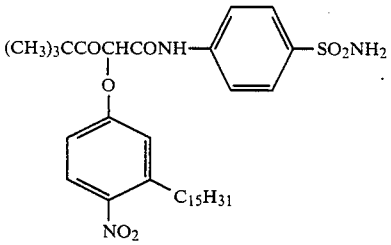

C-4

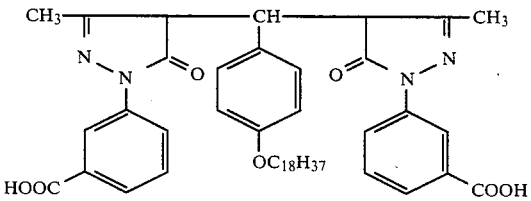

-continued
C-5
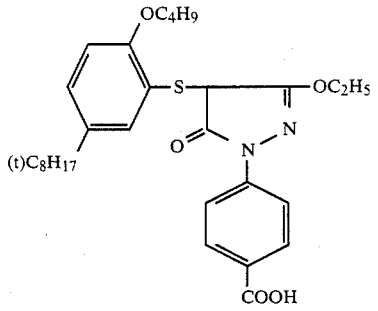
C-6
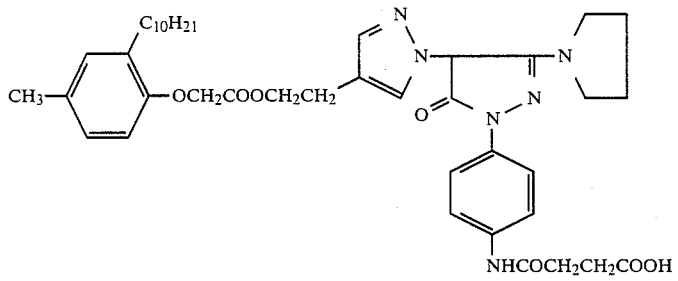
C-7
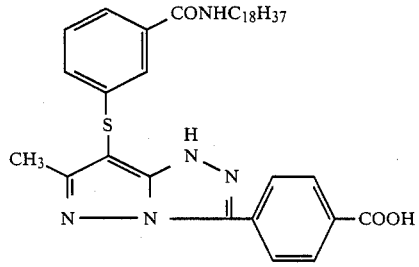
C-8
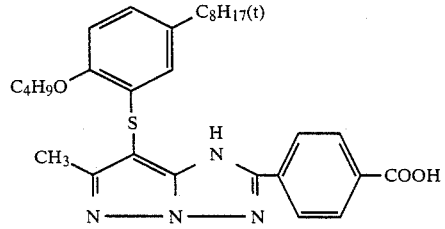
C-9
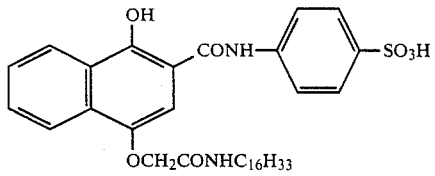
C-10
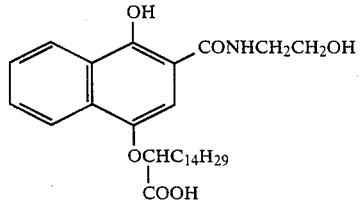

-continued
C-11
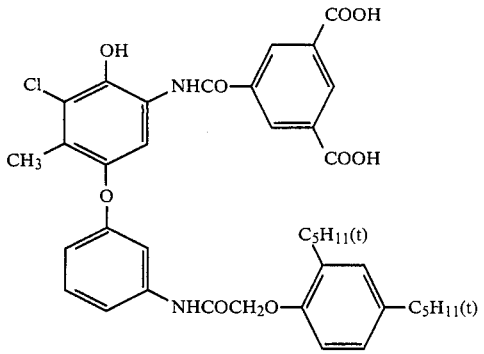
C-12
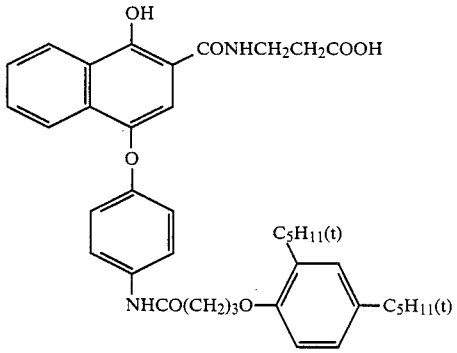
C-13
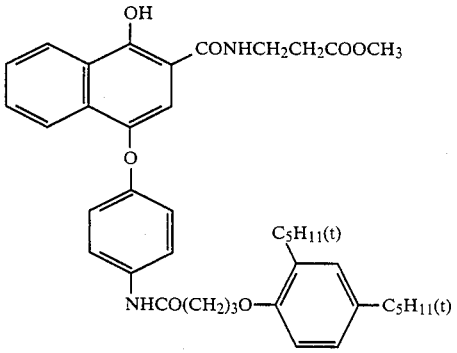
C-14
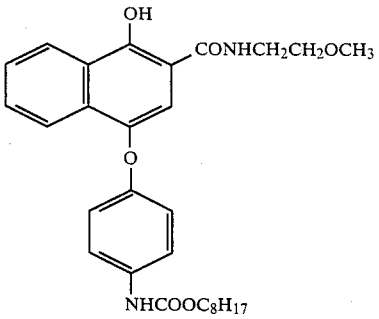
Compounds of group (2)
C-15
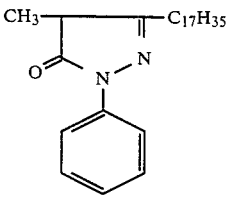

-continued
C-16
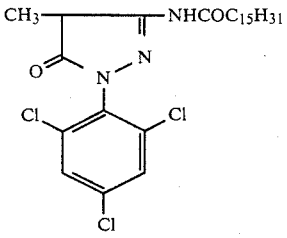
C-17
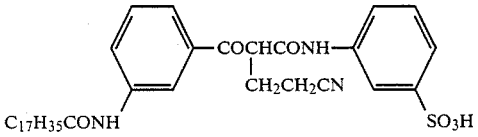
Compounds of group (3)
C-18
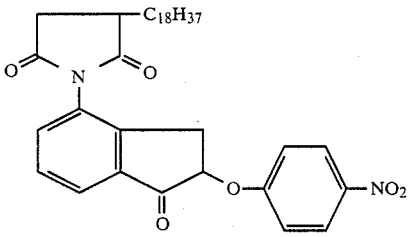
C-19
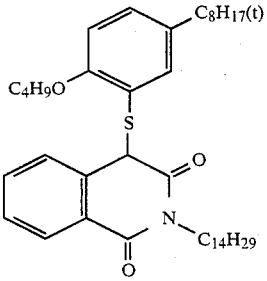
C-20
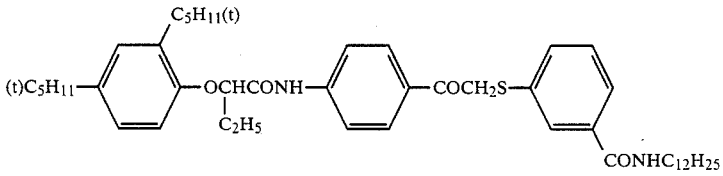
C-21
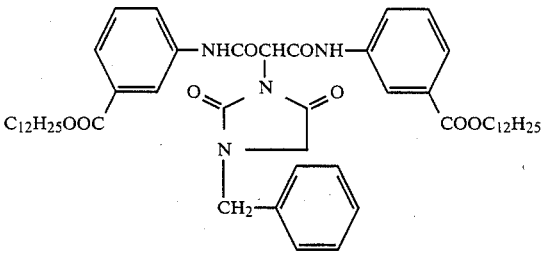
C-22
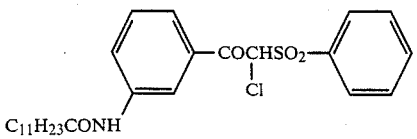

-continued

C-23

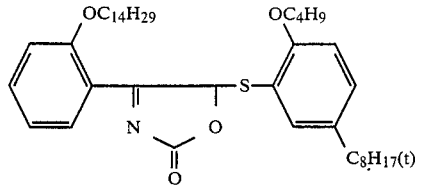

The DP' scavengers described above are most preferably incorporated in the photographic material of the present invention by being directly added to silver halide emulsion layers. They may also be incorporated in non-light-sensitive layers such as intermediate layers, protective layers, yellow filter layers or anit-halation layers.

The DP' scavengers are preferably added in amounts ranging from $1\times10^{-6}$ to $1\times10^{-1}$ mole per $m^2$ if they are incorporated in silver halide emulsion layers, with the range of $1\times10^{-5}$ to $2\times10^{-3}$ moles being particularly preferable. It should however be noted that the exact amount of DP' scavenger to be added is appropriately determined in accordance with the type of silver halide or the type of compound used as DP' scavenger. If the DP' scavengers are incorporated in silver halide-free layers such as intermediate layers, protective layers, yellow filter layers or anti-halation layers, the scavengers are preferably added in amounts ranging from $1\times10^{-6}$ to $1\times10^{-2}$ mole per $m^2$, with the range of $1\times10^{-5}$ to $1\times10^{-3}$ mole being more preferable.

The DP' scavengers may be incorporated in the light-sensitive material of the present invention by any known method such as the one described in U.S. Pat. No. 2,322,027.

The silver halide photographic material of the present invention may employ an image stabilizer for the purpose of preventing the deterioration of dye images. Preferable image stabilizers include: hydroquinone derivatives, gallic acid derivatives, phenolic derivatives or bis forms thereof, hydroxycoumaran or spiro forms thereof, hydroxychroman or spiro forms thereof, piperidine derivatives, aromatic amine compounds, benzodioxane derivatives, benzodioxonole derivatives, silicon atom containing compounds, and thioether compounds.

The hydrophilic colloidal layers such as protective layers and intermediate layers in the light-sensitive material of the present invention may contain antifoggants serving to prevent the occurrence of fogging due to discharge resulting from the light-sensitive material being charged by friction or other causes, or uv absorbers for preventing the deterioration of image due to uv radiation.

The light-sensitive material of the present invention may also contain a formaldehyde scavenger in order to prevent the deterioration of magenta-dye forming couplers or the like under the action of formaldehyde during storage.

Dyes, uv absorbers and other additives being incorporated in hydrophilic layers in the light-sensitive material may be mordanted with mordants such as cationic polymers.

Silver halide emulsion layers and/or other hydrophilic colloidal layers in the light-sensitive material may incorporate bleach accelerators or compounds such as development accelerator or restrainer that are capable of altering the developability of the material. Compounds that are preferably used as development accelerators are described in RD No. 17643, XXI, B–D, and compounds that are suitable for use as development restrainers are shown in RD No. 17643, XXI, E. Black-and-white developing agents and/or precursors thereof may be used for attaining accelerated development and other purposes.

In order to achieve increased sensitivity and contrast or to ensure accelerated development, the emulsion layers in the light-sensitive material of the present invention may contain polyalkylene oxides, derivatives thereof such as ether, ester and amine forms, thioether compounds, thiomorpholines, quaternary ammonium compounds, urethane derivatives, urea derivatives, or imidazole derivatives.

Brighteners may be used in the light-sensitive material in order to highlight the whiteness of the background and to mask any staining of the background. Compounds that are preferably used as brighteners are described in RD No. 17643, V.

The light-sensitive material of the present invention may be provided with auxiliary layers such as filter layers, anti-halation layers, and anti-irradiation layers. These layers and/or emulsion layers may have incorporated therein dyes that will be dissolved out of the light-sensitive material or bleached during development. Such dyes include oxonole dyes, hemioxonole dyes, styryl dyes, merocyanine dyes, cyanine dyes, and azo dyes.

Silver halide emulsion layers and/or other hydrophilic colloidal layers in the light-sensitive material of the present invention may contain matting agents for the purpose of reducing its gloss, increasing its adaptability to writing with a pencil, or preventing its adhesion to an adjacent light-sensitive material.

The light-sensitive material of the present invention may contain a lubricant that is capable of reducing its sliding friction.

The light-sensitive material may also contain an antistat for the purpose of preventing static buildup. The antistat may be incorporated in an antistatic layer on the side of the support where no emulsion layer is formed. Alternatively, the antistat may be incorporated in an emulsion layer and/or a protective layer. Compounds that are preferably used as antistats are described in RD No. 17643, X, III.

Photographic emulsion layers and/or other hydrophilic colloidal layers in the light-sensitive material of the present invention may contain a variety of surfactants for attaining such purposes as improved coating property, prevention of antistatic buildup, improved slipping property, emulsification/dispersion, antiblocking and improved photographic characteristics in terms of accelerated development, hard tone and sensitization.

Photographic emulsion layers and other layers for making the light-sensitive material of the present invention may be coated onto flexible reflecting supports such as paper or synthetic paper laminated with an o-olefin polymer (e.g., polyethylene, polypropylene or ethylene/butene copolymer), films made of semi-synthetic or synthetic polymers such as cellulose acetate, cellulose nitrate, polystyrene, polyvinyl chloride, polyethylene terephthalate, polycarbonate and polyamide, flexible supports having reflective layers formed on these films, or rigid supports made of such materials as glass, metals or ceramics.

After the support is optionally surface-treated by a suitable technique such as corona discharge, UV irradiation or flame treatment, hydrophilic colloidal layers for making a light-sensitive material may be coated onto the support either directly or with one or more subbing layers formed thereon. The subbing layers are provided for improving the adhesive strength, anti-static property, dimensional stability, wear resistance, hardness, anti-halation property, frictional characteristics and/or other characteristics of the surface of the support.

A thickener may be used in order to facilitate the coating operation performed for producing the photographic material of the present invention. There are additives such as hardeners which are reactive enough to cause premature gelling if they are preliminarily incorporated in the coating fluid. Such reactive additives are preferably mixed with the other components by means of a suitable device such as a static mixer just before the start of coating operation.

Particularly useful coating techniques are extrusion coating and curtain coating, both of which will enable simultaneous application of two or more layers. Bucket coating may be employed if a specific object permits. The coating speed may be selected at any desirable value.

The light-sensitive material of the present invention may be exposed to electromagnetic waves in the spectral region to which the emulsion layers that make up the light-sensitive material have sensitivity. Any known light sources may be used and they include daylight (sunshine), tungsten lamps, fluorescent lamps, mercury lamps, xenon arc lamps, carbon arc lamps, xenon flash lamps, CRT flying spot, light from a variety of lasers, LED emitted light, and light emitted from fluorescent materials upon excitation by electron beams, X-rays, gamma-rays or alpha-rays.

The exposure time may range from 1 millisecond to 1 second as is usually the case with cameras. Periods shorter than 1 microsecond, such as one ranging from 100 nanoseconds to 1 microsecond, may be employed with CRTs or xenon flash lamps. Exposure longer than 1 second would also be possible. The exposure may be continuous or intermittent.

The light-sensitive material of the present invention may be developed and processed by any known techniques. Processing may be achieved at temperatures between 18° C. and 50° C., and black-and-white processing, litho-type processing or color processing intended for producing dye images may be appropriately selected depending on a specific object.

The developing agent used in black-and-white processing is selected from among dihydroxybenzenes (e.g., hydroquinone), 3-pyrazolidones (e.g., 1-phenyl-3-pyrazolidone), aminophenols (e.g., N-methyl-p-aminophenol) and ascorbic acid, which may be used either alone or in combination. The developing solution employed contains known additives such as preservatives, alkali agents, pH buffers and fog restrainers. The developing solution may further contain a solubilizing agent, a toning agent, a development accelerator, a surfactant, a defoaming agent, a water softening agent, or a hardener. The concept of the present invention is also applicable to an "incorporated type" light-sensitive material which has a developing agent incorporated therein for being processed in an alkali bath.

An aqueous alkaline solution containing a color developing agent is employed in order to form a dye image. Known primary aromatic amino compounds such as phenylenediamines may be used as color developing agents. The color developing solution may also contain: a pH buffer such as an alkali metal sulfite, carbonate, borate or phosphate; a halide salt; an organic antifoggant; a water softener; a preservative; an organic solvent such as benzyl alcohol or ethylene glycol; or a development accelerator such as a quaternary ammonium salt or amine.

After color development, the light-sensitive material is usually subjected to bleaching, which may be effected either simultaneously with or separately from a fixing step. Exemplary bleaching agents are compounds of polyvalent metals such as iron (II), cobalt (III), chromium (IV) and copper (II), and persulfates. More specific examples include: ferrocyanides, bichromates, organic complex salts of iron or cobalt, ethylenediaminetetraacetic acid, nitrilotriacetic acid, persulfates and permanganates.

The following examples are provided for the purpose of further illustrating the present invention.

EXAMPLE 1

Two comparative emulsions, i.e., a negative-working silver iodobromide emulsion (A-1) containing 2.0 mol % AgI and a negative-working silver iodobromide emulsion (A-2) containing 18 mol % AgI, were chemically ripened to a maximum sensitivity by a combination of gold and sulfur sensitization techniques. Thereafter, the chemical ripening was stopped of silver halide.

An emulsion of the present invention, i.e., a negative-working working silver iodobromide emulsion (B) containing 7.0 mol % AgI, was likewise treated (chemical ripening and its stopping).

Each of the resulting emulsions, (A-1), (A-2) and (B), was divided into a predetermined number of portions, to which a comparative antifoggant compound and selected examples of the compound of the present invention were added in the amounts shown in Table 1. After the added compounds had been satisfactorily adsorbed onto the silver halide grains, suitable amounts of saponin (coating aid) and formaldehyde (hardener) were added so as to prepare finished emulsions.

The so prepared emulsions were uniformly coated onto subbed polyester bases for a silver deposit of 3 g/m$^2$ and subsequently dried to prepare photographic samples (Nos. 1–14).

The so prepared photographic samples were stored for 3 days under three different conditions, at room temperature, at 65° C.×7% R.H., and 50° C.×80% R.H. Thereafter, the samples were exposed through a conventional sensitometric wedge, developed for 30 seconds at 35° C. in a processing fluid (A) having the formulation shown below, and fixed. Subsequently, the samples were washed with water, dried and subjected to sensitivity measurement.

| Processing fluid (A) (for development of black-and-white photographic material) | |
|---|---|
| 1-Phenyl-3-pyrazolidone | 1.5 g |

-continued

| Processing fluid (A) (for development of black-and-white photographic material) | |
|---|---|
| Hydroquinone | 30 g |
| 5-Nitroindazole | 0.25 g |
| Potassium bromide | 5 g |
| Anhydrous sodium sulfite | 55 g |
| Potassium hydroxide | 30 g |
| Boric acid | 10 g |
| Glutaraldehyde (25% aq. sol.) | 5 g |
| Water | to make 1,000 ml |

The results of the measurements are shown in Table 1 wherein: the fog value excludes the base density; the sensitivity is expressed as a relative value for fog+0.5, with the value for Comparative Sample No. 9 (stored for 3 days in the ambient atmosphere) being taken as 100; and the gamma is indicated by the gradient of the straight portion of the characteristic curve.

In a separate step, 80 g of 1-(2,4,6-trichlorophenyl)-3-[3-(2,4-di-t-amylphenoxyacetamido)benzamido]-5-pyrazolone (magenta coupler) and 2.5 g of 1-(2,4,6-trichlorophenyl)-4-(1-naphthylazo)-3-(2-chloro-5-octadecenylsuccinimidoanilino)-5-pyrazolone (colored magenta coupler) were weighed per mole of silver halide. These couplers were then mixed with 120 g of tricresyl phosphate and 240 g of ethyl acetate and the mixture was heated to form a solution. This coupler solution was dispersed in 550 ml of a 7.5% aqueous gelatin solution containing 5 g of sodium triisopropylnaphthalenesulfonate, and the resulting dispersion was added to the previously prepared emulsion to make Emulsion C.

Emulsion C was divided into 10 portions, one of which was reserved as a blank sample. To the other portions, comparative anti-foggant compounds and selected samples of the compound of the present invention were added in the amounts shown in Table 2. After the added compounds had been satisfactorily adsorbed onto the silver halide grains, a suitable amount of 2-hydroxy-4,6-dichlorotriazine sodium was added as a gelatin hardener to each of the mixtures so as to prepare silver halide emulsions.

These emulsions and the blank sample were uniformly coated onto subbed cellulose triacetate films for a silver deposit of 3.0 g/m$^2$ and subsequently dried to prepare photographic samples (Nos. 15–24).

In a separate step, a high-sensitivity negative-working silver iodobromide emulsion (2.8 mol % AgI) having an average grain size of 1.2 μm was chemically ripened and optically sensitized in the same manner as described above. Thereafter, a magenta coupler was added to prepare Emulsion D.

TABLE 1

| Sample No. | Emulsion | Antifoggant | Amount (mg/mole AgX) | 3 days in the ambient atmosphere Fog | Sensitivity | Gamma | 3 days at 65° C. × 7% R.H. Fog | Sensitivity | Gamma | 3 days at 50° C. × 80% R.H. Fog | Sensitivity | Gamma |
|---|---|---|---|---|---|---|---|---|---|---|---|---|
| Comparative samples | | | | | | | | | | | | |
| 1 | A-1 | Comparative compound (a)* | 10 | 0.18 | 97 | 2.7 | 0.37 | 95 | 2.6 | 0.24 | 96 | 2.7 |
| 2 | A-1 | No. 1 | 300 | 0.17 | 98 | 2.8 | 0.34 | 97 | 2.7 | 0.23 | 96 | 2.6 |
| 3 | A-1 | No. 2 | 300 | 0.17 | 98 | 2.8 | 0.32 | 95 | 2.7 | 0.24 | 95 | 2.6 |
| 4 | A-1 | No. 9 | 300 | 0.18 | 98 | 2.7 | 0.34 | 97 | 2.7 | 0.22 | 96 | 2.7 |
| 5 | A-2 | Comparative compound (a) | 10 | 0.16 | 94 | 2.1 | 0.30 | 91 | 2.0 | 0.25 | 92 | 2.1 |
| 6 | A-2 | No. 1 | 300 | 0.17 | 94 | 2.2 | 0.28 | 92 | 2.1 | 0.23 | 91 | 2.2 |
| 7 | A-2 | No. 2 | 300 | 0.17 | 95 | 2.1 | 0.29 | 89 | 2.0 | 0.24 | 90 | 2.1 |
| 8 | A-2 | No. 9 | 300 | 0.17 | 96 | 2.1 | 0.30 | 94 | 2.1 | 0.24 | 93 | 2.1 |
| 9 | B | Comparative compound (a) | 10 | 0.17 | 100 | 2.5 | 0.35 | 102 | 2.4 | 0.26 | 100 | 2.5 |
| Samples of the invention | | | | | | | | | | | | |
| 10 | B | No. 1 | 300 | 0.17 | 100 | 2.5 | 0.18 | 100 | 2.6 | 0.18 | 98 | 2.5 |
| 11 | B | No. 2 | 300 | 0.17 | 98 | 2.4 | 0.19 | 99 | 2.5 | 0.19 | 99 | 2.5 |
| 12 | B | No. 9 | 300 | 0.18 | 100 | 2.5 | 0.19 | 98 | 2.5 | 0.19 | 100 | 2.5 |
| 13 | B | No. 12 | 300 | 0.18 | 100 | 2.5 | 0.19 | 100 | 2.6 | 0.20 | 100 | 2.6 |
| 14 | B | No. 19 | 300 | 0.18 | 97 | 2.4 | 0.19 | 100 | 2.5 | 0.20 | 98 | 2.5 |

*Comparative compound (a):

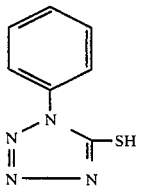

As Table 1 shows, sample Nos. 10–14 of the present invention experienced less fogging and gamma deterioration than the comparative samples even when they were stored under hostile conditions, and this demonstrates the improved stability of sample Nos. 10–14 during film storage.

EXAMPLE 2

A high-sensitivity negative-working silver iodobromide emulsion (6.0 mol % AgI) having an average grain size of 1.2 μm was chemically ripened to a maximum sensitivity with gold and sulfur sensitizers.

To the ripened emulsion, a suitable amount of a green sensitizing dye (5,5'-diphenyl-9-ethyl-3,3'-di-γ-sulfopropyloxacarbocyanine sodium salt) was added so as to prepare a green-sensitive silver halide emulsion.

Emulsion D was divided into 5 portions, to which selected samples of the compound of the present invention which were the same as used above were added in the amounts indicated in Table 2. As in the case of Emulsion C, the prepared emulsions were coated onto subbed cellulose triacetate films and subsequently dried to make comparative photographic samples (Nos. 25–29).

The so prepared photographic samples were stored for 3 days under accelerated conditions (65° C.×7% R.H.), wedge-exposed in a conventional manner, and subjected to color development in accordance with the processing scheme shown below.

Color sensitometric data were taken from the processed test pieces and are shown in Table 2 below. As in Table 1, the fog value excludes the base density; the sensitivity is expressed as a relative value with the value for Comparative Sample No. 15 (stored for 3 days in the ambient atmosphere) being taken as 100; and the gamma is indicated by the gradient of the straight portion of the characteristic curve.

| Processing scheme (at 38° C.) | Time |
|---|---|
| Color development | 3 min and 15 sec |
| Bleaching | 6 min and 30 sec |
| Washing | 3 min and 15 sec |
| Fixing | 6 min and 30 sec |
| Washing | 3 min and 15 sec |
| Stabilizing | 1 min and 30 sec |
| Drying | |

The formulations of the processing solutions used in the respective processing steps are as follows:

| | |
|---|---|
| [Color developer] | |
| 4-Amino-3-methyl-N—ethyl-N—(β-hydroxyethyl)aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Nitrilotriacetic acid trisodium salt | |

-continued

| | |
|---|---|
| (monohydrate | 2.5 g |
| Potassium hydroxide | 1.0 g |
| Water to make | 1 liter |
| pH adjusted to 10.6 with sodium hydroxide | |
| [Bleaching solution] | |
| Ethylenediaminetetraacetic acid iron ammonium salt | 100.0 g |
| Ethylenediaminetetraacetic acid diammonium salt | 10.0 g |
| Ammonium bromide | 150.0 g |
| Glacial acetic acid | 10.0 ml |
| Water to make | 1 liter |
| pH adjusted to 6.0 with ammonia water | |
| [Fixing solution] | |
| Ammonium thiosulfate | 175.0 g |
| Anhydrous sodium sulfite | 8.6 g |
| Sodium metasulfite | 2.3 g |
| Water to make | 1 liter |
| pH adjusted to 6.0 with acetic acid | |
| [Stabilizing solution] | |
| Formaldehyde (37% aq. sol.) | 1.5 ml |
| Konidax (produced by Konishiroku Photo Industry Co., Ltd.) | 7.5 ml |
| Water to make | 1 liter |

Comparative antifoggant compound (b)

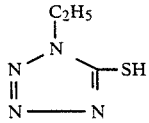

Comparative antifoggant compound (c)

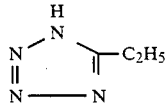

Comparative antifoggant compound (d)

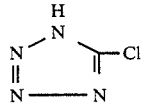

TABLE 2

| Sample No. | Emulsion | Antifoggant | Amount (mg/mole AgX) | 3 days in the ambient atomosphere | | | 3 days at 65° C. × 7% R.H. | | |
|---|---|---|---|---|---|---|---|---|---|
| | | | | Fog | Sensitivity | Gamma | Fog | Sensitivity | Gamma |
| Comparative samples | | | | | | | | | |
| 15 | C | — | — | 0.19 | 100 | 1.2 | 0.27 | 97 | 1.1 |
| 16 | C | Comparative compound (a) | 10 | 0.18 | 96 | 1.1 | 0.26 | 94 | 1.0 |
| 17 | C | Comparative compound (b) | 50 | 0.19 | 100 | 1.2 | 0.27 | 97 | 1.1 |
| 18 | C | Comparative compound (c) | 300 | 0.19 | 100 | 1.2 | 0.27 | 96 | 1.2 |
| 19 | C | Comparative compound (d) | 300 | 0.19 | 98 | 1.2 | 0.27 | 96 | 1.2 |
| Samples of the invention | | | | | | | | | |
| 20 | C | No. 2 | 300 | 0.18 | 99 | 1.2 | 0.19 | 99 | 1.2 |
| 21 | C | No. 3 | 300 | 0.18 | 100 | 1.1 | 0.19 | 98 | 1.1 |
| 22 | C | No. 6 | 350 | 0.19 | 100 | 1.2 | 0.21 | 100 | 1.1 |
| 23 | C | No. 16 | 350 | 0.19 | 100 | 1.2 | 0.20 | 100 | 1.2 |
| 24 | C | No. 18 | 350 | 0.19 | 100 | 1.2 | 0.20 | 98 | 1.2 |
| Comparative samples | | | | | | | | | |
| 25 | D | No. 2 | 300 | 0.21 | 97 | 1.3 | 0.26 | 95 | 1.2 |
| 26 | D | No. 3 | 300 | 0.21 | 96 | 1.3 | 0.26 | 95 | 1.3 |
| 27 | D | No. 6 | 350 | 0.20 | 97 | 1.2 | 0.29 | 96 | 1.2 |
| 28 | D | No. 16 | 350 | 0.21 | 97 | 1.3 | 0.29 | 96 | 1.2 |
| 29 | D | No. 18 | 350 | 0.21 | 96 | 1.3 | 0.28 | 95 | 1.3 |

As is clear from Table 2, the compound of formula (I) specified by the present invention was more effective than known compounds (a) to (d) in that it exhibited fog restraining effects without causing any deterioration of gradation or sensitivity even when photographic samples containing it were processed after storage under accelerated conditions.

EXAMPLE 3

Two samples of multilayered color light-sensitive material were prepared by successively coating cellulose triacetate film supports with the layers indicated below. The two samples had the same layer composition except that, in one sample, low iodide content emulsions (E) were used in the 3rd, 4th, 6th, 7th, 9th and 10th layers, and that in the other sample, high iodide content emulsions (F) were used in the same layers. For the AgI contents of the respective emulsions, E and F, used in these layers, see below.

| Layer | Emulsion E (comparison) AgI (mol %) | Emulsion F (according to the invention) AgI (mol %) |
|---|---|---|
| 3 (less red-sensitive layer) | 2.0 | 4.5 |
| 4 (highly red-sensitive layer) | 2.3 | 5.0 |
| 6 (less green-sensitive layer) | 2.5 | 4.2 |
| 7 (highly green-sensitive layer) | 2.5 | 5.0 |
| 9 (less red-sensitive layer) | 2.5 | 6.0 |
| 10 (highly red-sensitive layer) | 2.8 | 7.0 |

First layer: anti-halation layer which was a gelatin layer containing black colloidal silver Second layer: intermediate layer which was a gelatin layer Third layer: less red-sensitive emulsion layer containing a silver iodobromide emulsion with an average grain size of 0.5 μm which was coated for a silver deposit of 1.79 g/m$^2$; this layer contained the following additional components: sensitizing dye I, $6\times10^{-5}$ moles per mole of silver; sensitizing dye II, $3\times10^{-5}$ moles per mole of silver; coupler A, 0.06 moles per mole of silver; coupler C, 0.003 moles per mole of silver; coupler D, 0.003 moles per mole of silver; tricresyl phosphate deposit, 0.3 ml/m$^2$ Fourth layer: highly red-sensitive emulsion layer containing a silver iodobromide emulsion with an average grain size of 0.7 μm which was coated for a silver deposit of 1.4 g/m$^2$; this layer contained the following additional components: sensitizing dye I, $3\times10^{-5}$ moles per mole of silver; sensitizing dye II, $1.2\times10^{-5}$ moles per mole of silver; coupler F, 0.0125 moles per mole of silver; coupler C, 0.0016 moles per mole Fifth layer: intermediate layer which was the same as the second layer Sixth layer: less green-sensitive emulsion layer containing a silver iodobromide emulsion with an average grain size of 0.5 μm which was coated for a silver deposit of 1.0 g/m$^2$; this layer contained the following additional components; sensitizing dye III, $3\times10^{-5}$ moles per mole of silver; sensitizing dye IV, $1\times10^{-5}$ mole per mole of silver; coupler B, 0.08 moles per mole of silver; coupler M, 0.008 moles per mole of silver; coupler D, 0.0015 moles per mole of silver; tricresyl phosphate deposit, 1.4 ml/m$^2$ Seventh layer: highly green-sensitive emulsion layer containing a silver iodobromide emulsion with an average grain size of 0.75 μm which was coated for a silver deposit of 1.6 g/m$^2$; this layer contained the following additional components: sensitizing dye III, $2.5\times10^{-5}$ moles per mole of silver; sensitizing dye IV, $0.8\times10^{-5}$ moles per mole of silver; coupler B, 0.02 moles per mole of silver; coupler M, 0.003 moles per mole of silver; tricresyl phosphate deposit, 0.8 ml/m$^2$ Eighth layer: yellow filter layer which was a gelatin layer formed by coating an aqueous gelatin solution containing yellow colloidal silver Ninth layer: less blue-sensitive emulsion layer containing a silver iodobromide emulsion with an average grain size of 0.7 μm which was coated for a silver deposit of 0.5 g/m$^2$; this layer contained the following additional components: coupler Y, 0.125 moles per mole of silver; tricresyl phosphate deposit, 0.3 ml/m Tenth layer: highly blue-sensitive emulsion layer containing a silver iodobromide emulsion with an average grain size of 0.8 μm which was coated for a silver deposit of 0.6 g/m$^2$; this layer contained the following additional components: coupler Y, 0.04 moles per mole of silver; tricresyl phosphate deposit, 0.1 ml/m$^2$ Eleventh layer: protective layer which was formed by coating acrylate particles (1.5 μm dia.)

Each of the couplers to be incorporated in emulsion layers was prepared as follows: it was added to a solution of tricresyl phosphate and ethyl acetate; to the solution, sodium p-dodecylbenzenesulfonate was added as an emulsifying agent and the mixture was heated to form a solution; it was then mixed with a heated 10% gelatin solution and the mixture was emulsified in a colloid mill.

Each of the layers 1 to 12 also contained a gelatin hardener and a surfactant as required.

The so prepared samples were reserved as blank samples, Nos. 30 and 35.

The following sensitizing dyes and couplers were used.

Sensitizing dye I: anhydro-5,5'-dichloro-3,3'-di-(γ-sulfopropyl)-9-ethyl-thiacarbocyanine hydroxide pyridinium salt;

Sensitizing dye II: anhydro-9-ethyl-3,3'-di-(γ-sulfopropyl)-4,5,4',5'-dibenzothiacarbocyanine hydroxide triethylamine salt;

Sensitizing dye III: anhydro-9-ethyl-5,5'-dichlrro-3,3'-di-(65 -sulfopropyl)oxacarbocyanine hydroxide sodium salt;

Sensitizing dye IV: anhydro-5,6,5',6'-tetrachloro-1,1'-diethyl-3,3'-di-(β-[β-(γ-sulfopropoxy)-ethoxy]ethylimidazolocarbocyanine hydroxide sodium salt;

Coupler A:

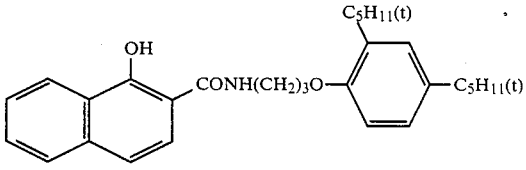

-continued
Coupler B:
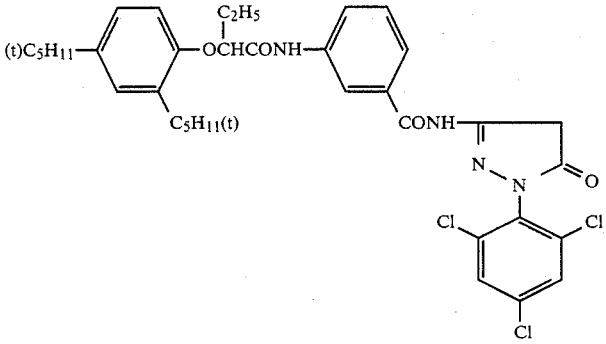
Coupler C:
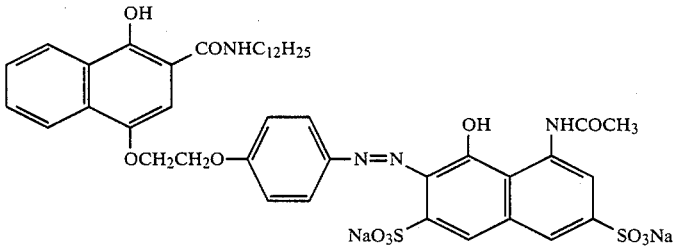
Coupler D:
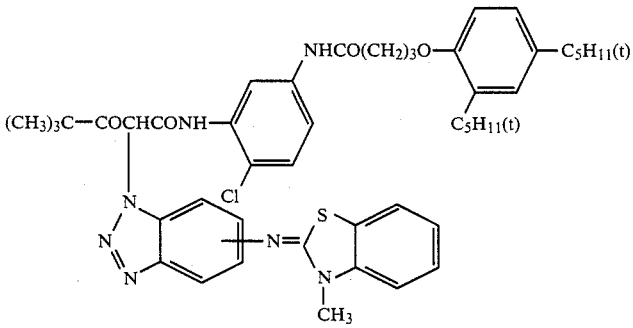
Coupler F:
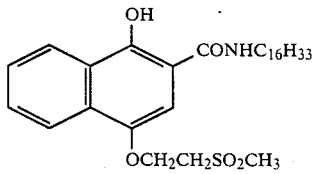
Coupler M:
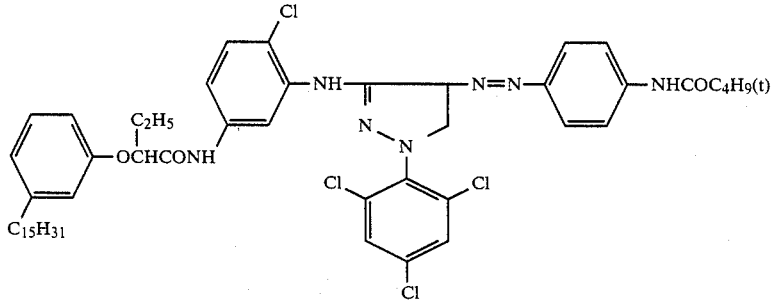
Coupler Y:

-continued

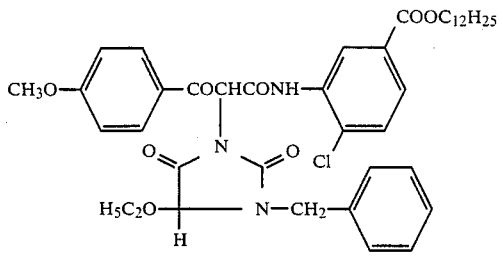

Each of the emulsion layers in sample Nos. 30 and 35 was prepared from a blank emulsion which, after chemical ripening with pertinent sensitizing dyes, had the ripening stopped by addition of 1 g, per mole of silver halide, of known 4-hydroxy-6-methyl-1,3,3a,7-tetrazaindene.

To this blank emulsion, selected samples of the compound of the present invention and comparative antifoggant compound (a) were added in the amounts shown in Table 3. After the added compounds had been satisfactorily adsorbed onto the silver halide grains, couplers, tricresyl phosphate and other necessary components were added. Subsequently, a suitable amount of 2-hydroxy-4,6-dichlorotriazine sodium was added as a hardener. The resulting emulsions were multi-coated on supports to make 12 samples of multi-layered color light-sensitive material (Nos. 31 to 34 and 36 to 43).

The two blank samples and the so prepared 12 samples were stored under two different conditions as in Example 2 before they were wedge-exposed by a conventional method and subjected to color processing as in Example 2. Color sensitometric data were taken from the processed samples and are shown in Table 3 below. As in Table 1, the fog value excludes the base density; and the sensitivity is expressed as a relative value, with the sensitivity of the blue-sensitive layers (this blue-sensitive layers include a less and a highly blue-sensitive layer) in blank sample No. 30 (stored for 3 days in the ambient atmosphere) being taken as 100.

TABLE 3

| Sample No. | Emulsion | Antifoggant Name | Antifoggant Amount (mg/mole AgX) | Blue-sensitive layer in the ambient atmosphere Fog | Blue-sensitive layer in the ambient atmosphere Sensitivity | Blue-sensitive layer at 65° C. × 7% R.H. Fog | Blue-sensitive layer at 65° C. × 7% R.H. Sensitivity | Green-sensitive layer in the ambient atmosphere Fog | Green-sensitive layer in the ambient atmosphere Sensitivity | Green-sensitive layer at 65° C. × 7% R.H. Fog | Green-sensitive layer at 65° C. × 7% R.H. Sensitivity | Red-sensitive layer in the ambient atmosphere Fog | Red-sensitive layer in the ambient atmosphere Sensitivity | Red-sensitive layer at 65° C. × 7% R.H. Fog | Red-sensitive layer at 65° C. × 7% R.H. Sensitivity |
|---|---|---|---|---|---|---|---|---|---|---|---|---|---|---|---|
| Comparative samples | | | | | | | | | | | | | | | |
| 30 | E | — | — | 0.19 | 100 | 0.30 | 96 | 0.20 | 103 | 0.31 | 98 | 0.13 | 102 | 0.22 | 100 |
| 31 | E | Comparative compound (a) | 15 | 0.18 | 98 | 0.28 | 97 | 0.19 | 100 | 0.27 | 99 | 0.12 | 100 | 0.20 | 98 |
| 32 | E | No. 2 | 300 | 0.18 | 98 | 0.27 | 98 | 0.19 | 99 | 0.26 | 100 | 0.12 | 100 | 0.20 | 99 |
| 33 | E | No. 3 | 300 | 0.19 | 100 | 0.27 | 97 | 0.19 | 100 | 0.27 | 98 | 0.12 | 100 | 0.19 | 98 |
| 34 | E | No. 12 | 300 | 0.19 | 97 | 0.28 | 97 | 0.20 | 100 | 0.27 | 99 | 0.12 | 100 | 0.20 | 98 |
| 35 | F | — | — | 0.17 | 100 | 0.24 | 92 | 0.16 | 100 | 0.23 | 95 | 0.11 | 99 | 0.20 | 97 |
| 36 | F | Comparative compound (a) | 15 | 0.17 | 100 | 0.22 | 98 | 0.16 | 98 | 0.22 | 96 | 0.10 | 99 | 0.19 | 100 |
| Samples of the invention | | | | | | | | | | | | | | | |
| 37 | F | No. 2 | 300 | 0.16 | 98 | 0.17 | 98 | 0.15 | 100 | 0.16 | 98 | 0.10 | 98 | 0.10 | 100 |
| 38 | F | No. 3 | 300 | 0.16 | 97 | 0.17 | 98 | 0.15 | 100 | 0.16 | 100 | 0.10 | 100 | 0.10 | 100 |
| 39 | F | No. 12 | 300 | 0.17 | 98 | 0.18 | 100 | 0.15 | 100 | 0.17 | 98 | 0.10 | 100 | 0.10 | 98 |
| 40 | F | No. 19 | 300 | 0.17 | 100 | 0.18 | 99 | 0.16 | 98 | 0.16 | 100 | 0.11 | 100 | 0.13 | 100 |
| 41 | F | No. 2<br>No. 4 | 150<br>150 | 0.17 | 100 | 0.18 | 100 | 0.16 | 100 | 0.17 | 100 | 0.11 | 100 | 0.13 | 98 |
| 42 | F | No. 2<br>No. 10 | 150<br>150 | 0.17 | 100 | 0.19 | 100 | 0.16 | 99 | 0.17 | 100 | 0.11 | 101 | 0.12 | 98 |
| 43 | F | No. 12<br>No. 20 | 150<br>150 | 0.17 | 100 | 0.18 | 99 | 0.16 | 97 | 0.17 | 100 | 0.11 | 100 | 0.13 | 100 |

As Table 3 shows, the samples of multi-layered color photographic material prepared in accordance with the present invention exhibited a good balance between the sensitivities of the individual emulsion layers and yet experienced restrained fogging without suffering from lowered sensitivities even when they were stored under hostile conditions before processing.

EXAMPLE 4

A high-sensitivity negative-working silver iodobromide emulsion (7.0 mol % AgI) having an average grain size of 0.8 μm was chemically ripened to a maximum sensitivity with gold and sulfur sensitizers.

To the ripened emulsion, a suitable amount of a blue sensitizing dye (anhydro-5,5'-dimethoxy-3,3'-di-γ-sulfopropylthiacyanine hydroxide) was added so as to prepare a blue-sensitive silver halide emulsion.

Eighty grams of a yellow coupler (No. 16 in the list of yellow couplers given in this specification) were weighed per mole of silver halide in the prepared blue-sensitive silver halide emulsion. This coupler was mixed with 40 g of tricresyl phosphate and 240 g of ethyl acetate and the mixture was heated to form a solution. This solution was dispersed in 550 ml of a 7.5% aqueous gelatin solution containing 5 g of sodium triisopropylnaphthalenesulfonate. The resulting coupler dispersion was added to the previously prepared emulsion to make Emulsion G.

Emulsion G was divided into 13 portions, one of which was reserved as a blank sample. To the other portions, comparative anti-foggant compound (c) and selected examples of the compound of the present invention were added in the amounts shown in Table 4. After the added compounds had been satisfactorily adsorbed onto the silver halide grains, a suitable amount of 2-hydroxy-4,6-dichlorotriazine sodium was added as a gelatin hardener to each of the mixtures so as to prepare silver halide emulsions.

In a separate step, a high-sensitivity negative-working silver iodobromide emulsion (2.0 mol % AgI) having an average grain size of 0.8 μm was chemically ripened and optically sensitized in the same manner as described above. Thereafter, a yellow coupler was added to prepare Emulsion H.

Emulsion H was divided into 13 portions, one of which was also reserved as a blank sample. To the other portions, comparative antifoggant compound (c) and selected examples of the compound of the present invention were added in the amounts shown in Table 4. The 13 portions of emulsion H were treated as in the case of emulsion G so as to prepare additional samples of silver halide emulsion.

Each of the samples of emulsion G and emulsion H were uniformly coated onto subbed cellulose triacetate film supports for a silver deposit of 3.0 g/m$^2$ and subsequently dried to prepare photographic samples (Nos. 44–69).

The so prepared photographic samples were stored for 2 days under three different conditions, in the ambient atmosphere, at 65° C.×7% R.H., and at 50° C.×80% R.H. Thereafter, the samples were exposed through a wedge by a conventional method and subjected to color processing in accordance with the same scheme as used in Example 2. The results of sensitometry conducted with the so processed samples are shown in Table 4, wherein the fog and sensitivity date should be interpreted as in Table 2.

TABLE 4

| Sample No. | Emulsion | Antifoggant | Amount (mg/mole AgX) | 2 days in the ambient atmosphere Fog | Sensitivity | 2 days at 65° C. × 7% R.H. Fog | Sensitivity | 3 days at 50° C. × 80% R.H. Fog | Sensitivity |
|---|---|---|---|---|---|---|---|---|---|
| 44 (comparison) | G | — | — | 0.19 | 100 | 0.31 | 93 | 0.23 | 95 |
| 45 (comparison) | G | Comparative compound (C) | 300 | 0.19 | 98 | 0.30 | 93 | 0.23 | 97 |
| Sample of the invention | | | | | | | | | |
| 46 | G | No. 1 | 300 | 0.18 | 100 | 0.20 | 97 | 0.19 | 98 |
| 47 | G | No. 5 | 300 | 0.18 | 101 | 0.20 | 97 | 0.19 | 99 |
| 48 | G | No. 7 | 300 | 0.19 | 100 | 0.22 | 96 | 0.20 | 95 |
| 49 | G | No. 8 | 300 | 0.19 | 100 | 0.21 | 98 | 0.20 | 98 |
| 50 | G | No. 9 | 300 | 0.18 | 102 | 0.20 | 97 | 0.20 | 98 |
| 51 | G | No. 10 | 300 | 0.18 | 102 | 0.20 | 97 | 0.19 | 100 |
| 52 | G | No. 11 | 300 | 0.15 | 103 | 0.16 | 102 | 0.15 | 103 |
| 53 | G | No. 14 | 300 | 0.17 | 102 | 0.18 | 100 | 0.18 | 101 |
| 54 | G | No. 15 | 300 | 0.17 | 100 | 0.18 | 100 | 0.17 | 100 |
| 55 | G | No. 17 | 300 | 0.16 | 100 | 0.19 | 98 | 0.18 | 101 |
| 56 | G | No. 19 | 300 | 0.16 | 102 | 0.18 | 100 | 0.17 | 101 |
| Comparative samples | | | | | | | | | |
| 57 | H | — | — | 0.21 | 93 | 0.34 | 89 | 0.25 | 90 |
| 58 | H | Comparative compound (C) | 300 | 0.20 | 94 | 0.33 | 88 | 0.25 | 89 |
| 59 | H | No. 1 | 300 | 0.19 | 94 | 0.29 | 89 | 0.20 | 92 |
| 60 | H | No. 5 | 300 | 0.19 | 95 | 0.28 | 87 | 0.22 | 94 |
| 61 | H | No. 7 | 300 | 0.20 | 94 | 0.29 | 89 | 0.22 | 93 |
| 62 | H | No. 8 | 300 | 0.21 | 93 | 0.30 | 89 | 0.21 | 93 |
| 63 | H | No. 9 | 300 | 0.19 | 94 | 0.29 | 89 | 0.20 | 94 |
| 64 | H | No. 10 | 300 | 0.19 | 93 | 0.28 | 88 | 0.21 | 92 |
| 65 | H | No. 11 | 300 | 0.18 | 100 | 0.26 | 93 | 0.19 | 98 |
| 66 | H | No. 14 | 300 | 0.18 | 98 | 0.28 | 90 | 0.20 | 92 |
| 67 | H | No. 15 | 300 | 0.19 | 97 | 0.28 | 89 | 0.21 | 94 |
| 68 | H | No. 17 | 300 | 0.20 | 96 | 0.27 | 91 | 0.21 | 93 |
| 69 | H | No. 19 | 300 | 0.19 | 97 | 0.27 | 90 | 0.20 | 95 |

As Table 4 shows, the compound of formula (I) of the present invention exhibited good ability to restrain fogging without causing lowered sensitivity when it was incorporated in silver halide emulsions of high iodide content for color photography that were contained in photographic materials which were then exposed to a hot and humid atmosphere prior to processing. Sample Nos. 51–56 which employed compounds wherein Y in formula (I) was substituted by heterocyclic groups exhibited particularly good sensitivity vs. fog profiles.

EXAMPLE 5

Two emulsions, A-3 and A-4, each comprising twinned silver halide grains having a uniform AgI composition as shown in Table 5 were prepared by the following procedures.

To a solution containing 1% gelatin and potassium bromide that was being agitated at 60° C., a solution of silver nitrate and a solution containing a mixture of potassium iodide and potassium bromide were added by the double-jet method. The AgI content of each emulsion was controlled by adjusting the KI content. The grain size was controlled by altering the period of addition over the range of 20–90 minutes.

TABLE 5

| Emulsion sample | AgI content (mol %) | Average grain size (μm) | Spread of distribution (%) |
|---|---|---|---|
| A - 3 | 7 | 0.44 | 36 |
| A - 4 | 4 | 0.47 | 38 |

Subsequently, three light-sensitive, core/shell type silver halide emulsions, B-1, B-2 and B-3, having the characteristics shown in Table 6 were prepared by the following procedures.

To a solution containing 1% gelatin and potassium bromide that was being agitated at 60° C., a solution of silver nitrate and Solution (1) containing a mixture of potassium iodide and potassium bromide were added by the double-jet method so as to form a core portion. Then, a solution of silver nitrate and Solution (2) containing potassium bromide either alone or in admixture with potassium iodide present in a smaller amount than in solution (1) were added to the agitated solution of 1% gelatin and potassium bromide by the double-jet method so as to form a shell portion. All of the silver halide grains thus formed were twinned.

TABLE 6

| Emulsion | Average grain size (μm) | Spread of distribution (%) | AgI content (mol %) core | AgI content (mol %) shell | Shell volume ratio (%) | Average AgI content (mol %) |
|---|---|---|---|---|---|---|
| B - 1 | 0.45 | 35 | 5 | 0 | 40 | 3.0 |
| B - 2 | 0.47 | 36 | 17 | 0 | 70 | 5.1 |
| B - 3 | 0.46 | 36 | 11 | 2 | 40 | 7.4 |

In a separate step, five monodispersed core/shell type emulsions, B-4, B-5, B-6, B-7 and B-8, having the characteristics shown in Table 7 were prepared by the following procedures.

First, seed grains having average sizes of 0.10 μm and 0.30 μm were prepared by the acid process. Each type of seed grains had a AgI content of 2.0 mol %. Using these seed grains and in accordance with the methods described in Japanese Patent Application (OPI) Nos. 48521/1979 and 49938/1983, core and shell portions were prepared by the double-jet method with the pAg and pH controlled in the presence of ammonia. The grain size of the silver halide being formed was controlled by changing the type of seed grains used and the amount of silver added. The compositions of core, intermediate layer and shell were controlled by varying the compositions of halide solutions being added.

With a view to producing grains having increased monodispersity, two emulsions, B-6 and B-8, were prepared by allowing the seed grains to grow in the presence of 0.15 g of 4-hydroxy-6-methyl-1,3,3a,7-tetrazaindene per mole of silver halide.

TABLE 7

| Emulsion | Average grain size (μm) | Spread of distribution (%) | AgI content (mol %) core | AgI content (mol %) inter-layer | AgI content (mol %) shell | Shell (or interlayer) volume ratio (%) | Average AgI content (mol %) | Grain shape |
|---|---|---|---|---|---|---|---|---|
| B - 4 | 0.45 | 14 | 8 | — | 0 | 30 | 5.6 | tetradecahedral |
| B - 5 | 0.45 | 13 | 11 | — | 2 | 40 | 7.4 | Octahedral |
| B - 6 | 0.45 | 10 | 14 | — | 1 | 45 | 8.15 | Octahedral |
| B - 7 | 0.45 | 13 | 15 | 5 | 2 | interlayer, 30 shell, 35 | 7.45 | tetradecahedral |
| B - 8 | 0.45 | 10 | 17 | 6 | 0.5 | interlayer, 35 shell, 40 | 6.55 | Octahedral |

Two additional samples of monodispersed core/shell emulsion, B-9 and B-10, were prepared by the following procedures. To an aqueous solution containing gelatin and potassium bromide that was being agitated at 40° C., a solution of silver nitrate was added so as to make a nuclear emulsion comprising multiply twinned grains. Subsequently, this emulsion was physically ripened in the presence of ammonia and potassium bromide so as to produce a monodispersed emulsion comprising spherical seed grains. Using this seed emulsion, a core/shell emulsion was prepared by the double-jet method with the pAg and pH being controlled in the presence of ammonia and 4-hydroxy-6-methyl-1,3,3a,7-tetrazaindene. The compositions of core and shell in this emulsion were controlled by adjusting the compositions of halide solutions being added. The characteristics of B-9 and B-10 are shown in Table 8 below.

TABLE 8

| Emulsion | Grain size (μm) | Spread of distribution (%) | AgI content (mol %) core | AgI content (mol %) shell | Shell volume ratio (%) | Average AgI content (mol %) | Grain shape |
|---|---|---|---|---|---|---|---|
| B - 9 | 0.47 | 18 | 10 | 2 | 50 | 6.0 | twinned |
| B - 10 | 0.47 | 19 | 15 | 0 | 50 | 7.5 | twinned |

Emulsions, A-3 and A-4 and B-1 to B-10, thus prepared were chemically ripened by known procedures and optically sensitized with a sensitizing dye, anhydro-5,5'-diphenyl-9-ethyl-3,3'-di-(3-sulfobutyl)oxacarbocyanine hydroxide. Some of the so treated emulsions were divided into a predetermined number of portions, to which comparative antifoggant compounds (a), (c) and (e) and selected examples of the compound of the present invention were added in the amounts shown in Table 9. Thereafter, coating fluids for emulsion and protective layers were prepared in accordance with the schedules shown below and coated onto subbed triacetyl cellulose film supports so as to make photographic samples, Nos. 5-1 to 5-21.

(1) Emulsion layer (i) one of the emulsions shown in Table 9 . . . silver deposit, 2.0 g/m$^2$ (ii) coupler (M-1) . . . $1.8\times10^{-3}$ moles/m$^2$ (M-1)

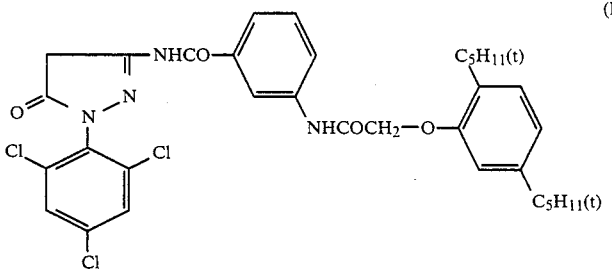

(iii) tricresyl phosphate . . . 1.1 g/m$^2$ (iv) gelatin . . . 2.3 g/m$^2$ (2) Protective layer (i) 2,4-dichlorotriazine-6-hydroxy-S-triazine sodium salt . . . 0.08 g/m$^2$ (ii) gelatin . . . 11.8 g/m$^2$ The photographic samples thus prepared were stored for 8 hours at 45° C. and at 70% R.H., then given sensitometric exposure, and subjected to color processing by the following scheme.

| Processing scheme (38° C.) | Time |
|---|---|
| Color development | 2 min and 40 sec |
| Bleaching | 6 min and 30 sec |
| Washing | 3 min and 15 sec |
| Fixing | 6 min and 30 sec |
| Washing | 3 min and 15 sec |
| Stabilizing | 1 min and 30 sec |
| Drying | |

The formulations of the processing fluids were identical to those employed in Example 2.

Comparative antifoggant compounds (a) and (c) were identical to those employed in Example 2, and comparative compound (e) had the following structure:

compound (e)

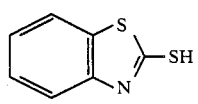

The sensitivity and fog data in Table 9 are expressed as relative values with the respective values for sample No. 5-1 being taken as 100. Part of each sample was subjected to thermal treatment (ie, standing for 5 days at 55° C. and 20% R.H.) was thereafter exposed and subjected to photographic processing. The fog variations resulting from thermal treatment are shown in Table 9, with the value for sample No. 5-1 ($\Delta$fog$=+0.18$) being taken as 100.

TABLE 9

| | Sample No. | Emulsion | Antifoggant compound | Amount (mg/mole AgX) | Sensitivity | Fog | Variation in fog after storage for 5 days at 55° C. |
|---|---|---|---|---|---|---|---|
| Comparative samples | 5-1 | A-3 | — | 0 | 100 | 100 | 100 |
| | 5-2 | B-3 | — | 0 | 140 | 120 | 120 |
| | 5-3 | B-8 | — | 0 | 160 | 110 | 160 |
| | 5-4 | B-9 | — | 0 | 150 | 105 | 150 |
| | 5-5 | B-8 | comparative compound (a) | 100 | 140 | 110 | 155 |
| | 5-6 | B-8 | comparative compound (e) | 100 | 100 | 105 | 160 |
| | 5-7 | B-8 | comparative compound (c) | 100 | 105 | 110 | 150 |
| | 5-8 | A-3 | No. 11 | 100 | 90 | 90 | 80 |
| Samples of the invention | 5-9 | A-4 | No. 11 | 100 | 120 | 90 | 80 |
| | 5-10 | B-1 | No. 11 | 100 | 140 | 80 | 50 |
| | 5-11 | B-2 | No. 11 | 100 | 148 | 70 | 60 |
| | 5-12 | B-3 | No. 11 | 100 | 155 | 70 | 40 |

TABLE 9-continued

| Sample No. | Emulsion | Antifoggant compound | Amount (mg/mole AgX) | Sensitivity | Fog | Variation in fog after storage for 5 days at 55° C. |
|---|---|---|---|---|---|---|
| 5-13 | B-4 | No. 11 | 100 | 160 | 60 | 40 |
| 5-14 | B-5 | No. 11 | 100 | 155 | 80 | 60 |
| 5-15 | B-6 | No. 11 | 100 | 180 | 70 | 50 |
| 5-16 | B-7 | No. 11 | 100 | 195 | 30 | 30 |
| 5-17 | B-8 | No. 11 | 100 | 205 | 30 | 30 |
| 5-18 | B-9 | No. 11 | 100 | 185 | 40 | 40 |
| 5-19 | B-10 | No. 11 | 100 | 175 | 50 | 40 |
| 5-20 | B-8 | No. 20 | 100 | 195 | 40 | 35 |
| 5-21 | B-8 | No. 9 | 100 | 195 | 60 | 40 |

The following conclusions can be obtained from the data in Table 9:

(1) the core/shell emulsions achieved higher sensitivities than ordinary twinned emulsions although they experienced somewhat higher amounts of fogging; however, the core/shell emulsions suffered from significantly high amounts of fog variations after thermal treatment;

(2) when the compound of the present invention was incorporated in emulsion, a reduction in fog value was attained; however, with ordinary twinned emulsions, this reduction in fogging was accompanied by a decrease in sensitivity with no improvement achieved in the resistance to thermal fogging; and (3) when core/shell emulsions were combined with the compound of the present invention, a pronounced decrease in fogging occurred and, surprisingly enough, even a slight improvement in sensitivity was achieved; the combination of core/shell emulsions with the compound of the present invention was also effective in suppressing the occurrence of thermal fogging. However, when core/shell emulsions were used in combination with comparative antifoggant compound (a), (c) or (e), a decrease in sensitivity occurred and, furthermore, no reduction in thermal fogging was achieved.

EXAMPLE 6

Unless otherwise noted, the amounts of components in the silver halide photographic materials prepared in the following examples are based on a unit area of 1 $m^2$ and the amounts of silver halide and colloidal silver are indicated in terms of silver.

A sample (No. 6-1) of multi-layered color photographic element was prepared by coating a triacetyl cellulose film base with successive layers having the compositions shown below, with the first layer positioned closest to the base.

Sample No. 6-1 (comparison)

First layer: anti-halation layer (HC-1) which was a gelatin layer containing black colloidal silver Second layer: intermediate layer (I.L.) which was a gelatin layer containing a dispersion of 2,5-di-t-octylhydroquinone Third layer: less red-sensitive silver halide emulsion layer (RL-1) comprising a monodispersed emulsion (Em-I) composed of AgBrI grains (6 mol % AgI) with an average size ($\bar{r}$) of 0.30 μm and which was coated for a Ag deposit of 1.8 g/$m^2$; this layer contained the following additional components: sensitizing dye XI, $6\times10^{-5}$ moles per mole of silver; sensitizing dye XII, $1.0\times10^{-5}$ mole per mole of silver; cyan coupler (C-1), 0.06 moles per mole of silver; colored cyan coupler (CC-1), 0.003 moles per mole of silver; DIR compound (D-1), 0.0015 moles per mole of silver; DIR compound (D-2), 0.002 moles per mole of silver Fourth layer: highly red-sensitive silver halide emulsion layer (RH-1) comprising a monodispersed emulsion (Em-II) composed of AgBrI grains (7.0 mol % AgI) with an average size (r) of of 1.3 g/$m^2$; this layer contained the following additional components: sensitizing dye XI, $3\times10^{-5}$ moles per mole of silver; sensitizing dye XII, $1.0\times10^{-5}$ mole per mole of silver; cyan coupler (C-1), 0.002 moles per mole of silver; colored cyan coupler (CC-1), 0.0015 moles per mole of silver; DIR compound (D-2), 0.001 mole per mole of silver Fifth layer: intermediate layer (I.L.) which was the same gelatin layer as the second layer Sixth layer: less green-sensitive silver halide emulsion layer (GL-1) comprising Em-I which was coated for a Ag deposit of 1.5 g/$m^2$; this layer contained the following additional components; sensitizing dye XIII, $2.5\times10^{-5}$ moles per mole of silver; sensitizing dye XIV, $1.2\times10^{-5}$ moles per mole of silver; magenta coupler (M-1), 0.050 moles per mole of silver; colored magenta coupler (CM-1), 0.009 moles per mole of silver; DIR compound (D-1), 0.0010 mole per mole of silver; DIR compound (D-3), 0.0030 moles per mole of silver Seventh layer: highly green-sensitive silver halide emulsion layer (GH-1) comprising Em-II which was coated for Ag deposit of 1.4 g/$m^2$; this layer contained the following additional components: sensitizing dye XIII, $1.5\times10^{-5}$ moles per mole of silver; sensitizing dye XIV, $1.0\times10^{-5}$ mole per mole of silver; magenta coupler (M-1), 0.020 moles per mole of silver; colored magenta coupler (CM-1), 0.002 moles per mole of silver; DIR compound (D-3), 0.0010 mole per mole of silver Eighth layer: yellow filter layer (YC-1) which was a gelatin layer containing a dispersion of yellow colloidal silver and 2,5-di-octyl hydroquinone Ninth layer: less blue-sensitive silver halide emulsion layer (BL-1) comprising a monodispersed emulsion (Em-III) composed of AgBrI grains (16 mol % AgI) with an average size of 0.48 μm and which was coated for Ag deposit of 0.9 g/$m^2$; this layer contained the following additional components: sensitizing dye XV, $1.3\times10^{-5}$ moles per mole of silver; yellow coupler (for its name, see Table 10), 0.29 moles per mole of silver Tenth layer: highly blue-sensitive emulsion layer (BH-1) composed of a monodispersed emulsion (Em-IV) composed of AgBrI grains (15 mol % AgI) with an average size of 0.8 μm and which was coated for Ag deposit of 0.5 g/$m^2$; this layer contained the following additional components: sensitizing dye XV, $1.0\times10^{-5}$ mole per mole of silver; yellow coupler (for its name, see Table 10), 0.08 moles per mole of silver; DIR compound (D-2), 0.0015 moles per mole of silver Eleventh layer: first protective layer (Pro-1) which was a gelatin layer that contained AgBrI (1 mol % AgI; average grain size, 0.07 μm) coated for Ag deposit of 0.5 g/m$^2$, as well as uv absorbers, UV-1 and UV-2

Twelfth layer: second protective layer (Pro-2) which was a gelatin layer that contained polymethyl methacrylate particles (1.5 μm dia.) and a formaldehyde scavenger (HS-1)

Each of the layers 1 to 12 also contained a gelatin hardener (H-1) and a surfactant as required.

The following sensitizing dyes, couplers, UV absorbers, formaldehyde scavenger, and gelatin hardeners were used.

Sensitizing dye XI: anhydro-5,5-dichloro-9-ethyl-3,3'-di-(3-sulfopropyl)thiacarbocyanine hydroxide;

sensitizing dye XII: anhydro-9-ethyl-3,3'-di-(3-sulfopropyl)-4,5,4'5'-dibenzothiacarbocyanine hydroxide;

sensitizing dye XIII: anhydro-5,5'-diphenyl-9-ethyl-3,3'-di-(3-sulfopropyl)oxacarbocyanine hydroxide;

sensitizing dye XIV: anhydro-9-ethyl-3,3'-di-(3-sulfopropyl)-5,6,5',6'-dibenzoxacarbocyanine hydroxide;

sensitizing dye XV: anhydro-3,3'-di-(3-sulfopropyl)-4.5-benzo-5'-methoxythiacyanine;

C-1

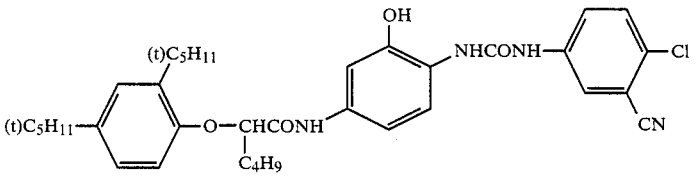

CC-1

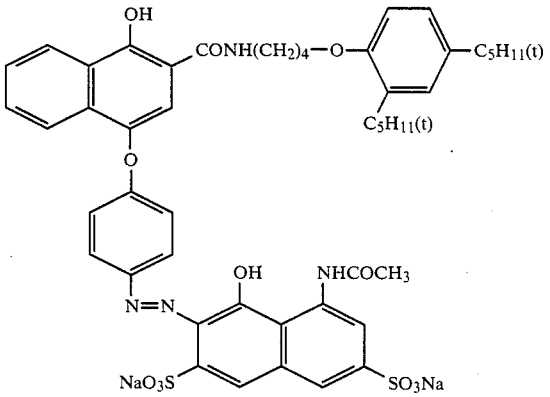

D-1

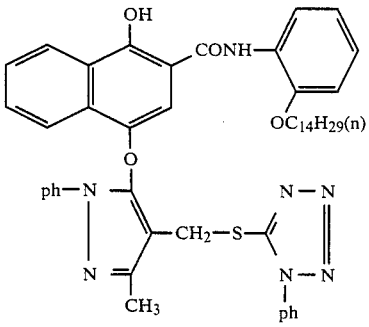

D-2

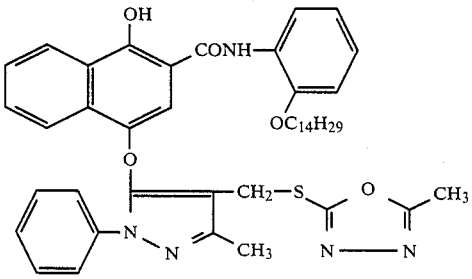

-continued
D-3
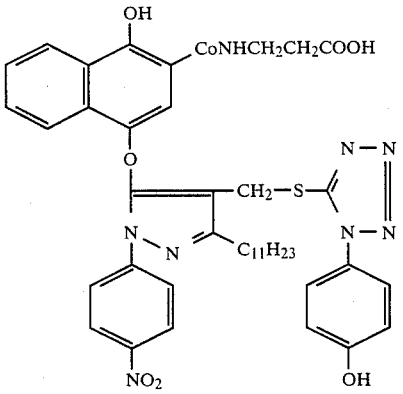
M-1
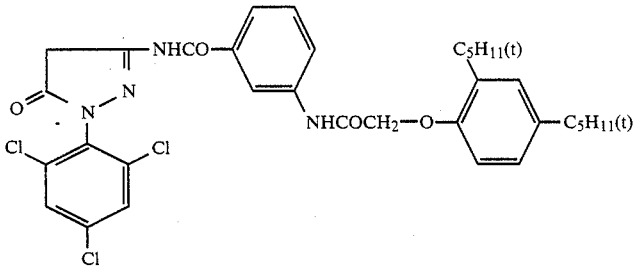
CM-1
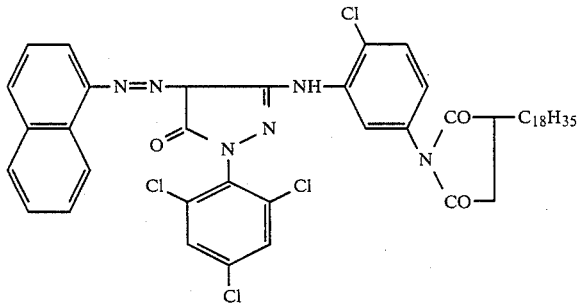
α-pivaloyl-α-(1-benzyl-2-phenyl-3,5-dioximidazolidin-4-yl)-2-chloro-5-[α-(dodecyloxycarbonyl)ethoxycarbonyl]acetanilide Y-A
UV-1
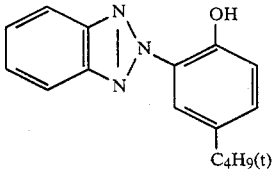
UV-2
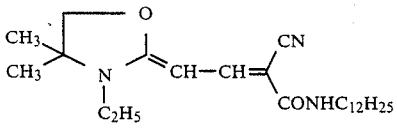
HS-1
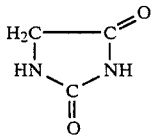
H-1
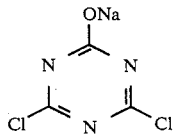

-continued $$[(CH_2{=}CHSO_2CH_2)_3CCH_2SO_2C_2H_4]_2N\text{-}CH_2CH_2SO_3K \qquad \text{H-2}$$

Additional samples, No. 6-2 to No. 6-12, were prepared in the same manner as described above except that layers 9 to 12 in sample No. 6-1 were changed as specified in Table 10 below.

TABLE 10

| Sample No. | 6-1 | 6-2 | 6-3 | 6-4 | 6-5 | 6-6 | 6-7 | 6-8 | 6-9 | 6-10 |
|---|---|---|---|---|---|---|---|---|---|---|
| | (outside the scope of the invention) | | | | | (within the scope of the invention) | | | | |
| Additives in layer 12 | — | — | — | — | — | — | — | — | — | — |
| Amount (mg/m$^2$) | — | — | — | — | — | — | — | — | — | — |
| Additives in layer 11 | — | — | — | — | — | — | No. 11 | — | — | — |
| Amount (mg/m$^2$) | — | — | — | — | — | — | 100 mg/m$^2$ | — | — | — |
| Coupler in layer 10 | Y-A | Y-15 | Y-16 | Y-A | Y-15 | Y-16 | Y-16 | Y-15 | Y-15 | Y-15 |
| Amount (mol/l mol Ag) | 0.08 | 0.08 | 0.08 | 0.08 | 0.08 | 0.08 | 0.08 | 0.08 | 0.08 | 0.08 |
| Additives in layer 10 | — | Comp. *1 | Comp. *2 | No. 11 | No. 11 | No. 11 | — | No. 20 | No. 9 | — |
| Amount (mg/l mol Ag) | — | 100 | 100 | 100 | 100 | 100 | — | 100 | 100 | — |
| Coupler in layer 9 | Y-A | Y-A | Y-16 | Y-A | Y-A | Y-16 | Y-16 | Y-A | Y-A | Y-A |
| Amoung (mol/l mol Ag) | 0.29 | 0.29 | 0.29 | 0.29 | 0.29 | 0.29 | 0.29 | 0.29 | 0.29 | 0.29 |
| Additives in layer 9 | — | — | — | — | — | — | — | — | — | No. 11 |
| Amount (mg/l mol Ag) | — | — | — | — | — | — | — | — | — | 100 |

*1 Comparative compound (a)
*2 Comparative compound (c)
"—" in Table 10 means that the additives in layer 12 were the same as in Comparative Sample 6-1; a specific name of additive indicates that it was additionally incorporated in the relevant layer in Comparative Sample 6-1; a specific name of coupler indicates that it was substituted for coupler Y-A in Comparative Sample 6-1.

Three test pieces were prepared for each of the ten samples, No. 6-1 to No. 6-10. One test piece was stored for 4 days at 55° C. and at 20% R.H. before it was processed photographically as in Example 2; another test piece was immediately exposed under white light through an optical wedge and processed thereafter; the last piece was processed as in Example 2 except that the period of development was shortened to 2 minutes and 40 seconds. Each of the processed test pieces was subjected to sensitometry with blue light and to granularity measurement. The results are shown in Table 11. The individual parameters indicated in the table have the following meanings: fog, minimum optical density on the "characteristic curve" obtained by sensitometry (higher values of fog are not preferable); sensitivity, the reciprocal of the amount of exposure (antilogarithm) necessary to produce an optical density of fog plus 0.1 on the characteristic curve (in Table 11, sensitivity data are expressed in terms of relative values, with the value for the comparative sample being taken as 100; higher values of sensitivity are preferable); granularity, RMS which is the standard deviation, multiplied by 1,000, of the variation in density that occurs when a dye image having a density of Dmin plus 0.8 is scanned with a microdensitometer having a scanning aperture of 25 μm in diameter (in Table 11, granularity data are expressed in terms of relative values, with the value for a control sample being taken as 100; higher values of granularity are not preferable); storage stability, expressed as (fog occurring in a sample left at 55° C. and 20% R.H.)—(fog in a freshly processed sample) and smaller values indicate better storage stability; stability under varying processing conditions, expressed as (sensitivity of a sample developed for a period of 3 min and 15 sec) - (sensitivity of a sample developed for a period of 2 min and 40 sec) and smaller values indicates higher stability.

TABLE 11

| Sample No. | 6-1 | 6-2 | 6-3 | 6-4 | 6-5 | 6-6 | 6-7 | 6-8 | 6-9 | 6-10 |
|---|---|---|---|---|---|---|---|---|---|---|
| | (outside the scope of the invention) | | | | | (within the scope of the invention) | | | | |
| sensitivity | 100 | 70 | 80 | 95 | 120 | 115 | 120 | 115 | 120 | 115 |
| fog | 0.88 | 0.91 | 1.00 | 0.87 | 0.85 | 0.86 | 0.87 | 0.88 | 0.90 | 0.87 |
| granularity | 40 | 45 | 50 | 45 | 32 | 31 | 32 | 30 | 35 | 31 |
| storage stability | 0.30 | 0.25 | 0.31 | 0.10 | 0.09 | 0.10 | 0.11 | 0.10 | 0.15 | 0.05 |
| stability under varying processing conditions | 21 | 15 | 18 | 20 | 16 | 15 | 14 | 15 | 14 | 14 |

As the data in Table 11 shows, silver halide photographic materials having even better characteristics in terms of sensitivity, granularity, storage stability and stability under varying processing conditions could be obtained by incorporating benzoyl-type yellow couplers in the photographic composition specified by the present invention. The compound (I) of the present invention exhibited particularly good results when it was incorporated in silver halide emulsion layers or in layers adjacent thereto.

EXAMPLE 7

A sample of multi-layered color photographic element, No. 7-1, was prepared in the same manner as sample No. 6-1 was prepared in Example 6, except that yellow coupler Y-16 was used in layers 9 and 10. Additional samples, No. 7-2 to No: 7-16, were prepared as above except that the coupler dispersion in layer 7 was altered to those shown in Table 12 and that an antifoggant compound was incorporated in one or more of layers 6 to 8. The amount of each of the coupler dispersions in layer 7 of sample Nos. 7-2 to No. 7-16 was the same as what was used in sample No. 7-1. The compound (I) of the present invention serving as an antifoggant was used in an amount of 240 mg per mole of AgX when it was incorporated in layer 7; when it was incorporated in layer 6 or 8, its amount was 15 mg/m$^2$. This also holds true with compound (a) used as a comparative antifoggant.

TABLE 12

| Sample No. | Magenta coupler dispersion used in layer 7 in Sample 7-1 in place of M-1 | Compound 1 Name | Compound 1 Layer in which it was incoporated | Compound 2 Name | Compound 2 Layer in which it was in corporated | Remarks |
|---|---|---|---|---|---|---|
| 7-1 | — | — | — | — | — | Outside the scope |
| 7-2 | — | comparative compound (a) | layer 7 | — | — | of the invention |
| 7-3 | 4 | comparative compound (a) | layer 7 | — | — | |
| 7-4 | 4 | 20 | layer 7 | — | — | Within the scope |
| 7-5 | 4 | 19 | layer 7 | — | — | of the invention |
| 7-6 | 4 | 11 | layer 7 | — | — | |
| 7-7 | 4 | 3 | layer 7 | — | — | |
| 7-8 | 4 | 6 | layer 7 | — | — | |
| 7-9 | 4 | 11 | layer 7 | comparative compound (a) | layer 6 | |
| 7-10 | 4 | 11 | layer 7 | comparative compound (a) | layer 6 | |
| 7-11 | 4 | 11 | layer 7 | 20 | layer 6 | |
| 7-12 | 4 | 11 | layer 7 | 19 | layer 6 | |
| 7-13 | 4 | 11 | layer 8 | — | — | |
| 7-14 | 26 | 11 | layer 7 | — | — | |
| 7-15 | 2 | 11 | layer 7 | — | — | |
| 7-16 | 5 | 11 | layer 7 | — | — | |

Two test pieces were prepared for each of the 16 samples, No. 7-1 to No. 7-16. One test piece was stored for 4 days at 55° C. and at 20% R.H. before it was processed photographically as in Example 2; and the other test piece was immediately exposed under white light through an optical wedge and processed thereafter.

The color images produced in the processed samples, No. 7-1 to No. 7-16, were subjected to the measurement of green fog and green sensitivity with a densitometer. The results are shown in Table 13 wherein green (G) sensitivity data are expressed in terms of relative values, with the value for the piece of sample No. 7-1 that was processed immediately after its preparation being taken as 100. The fog data for the test piece that was stored for 4 days at 55° C. and 20% R.H. are expressed in terms of Afog, which is calculated as (fog in the sample processed after storage at 55° C.×20% R.H.)−(fog in the sample processed immediately after its preparation); the G sensitivity data for the same test piece are expressed in terms of % variation in sensitivity, which is calculated as (G sensitivity in the sample processed after storage at 55° C.×20% R.H.)/(G sensitivity in the sample processed immediately after its preparation)×100.

TABLE 13

| Sample No. | Immediately processed G fog | Immediately processed G sensitivity | Pressed after storage at 55° C. × 20% R.H. ΔG fog | Pressed after storage at 55° C. × 20% R.H. ΔG sensitivity (%) | Remarks |
|---|---|---|---|---|---|
| 7-1 | 0.52 | 100 | +0.28 | −30.3 | Outside the scope |
| 7-2 | 0.44 | 85 | +0.20 | −21.5 | of the invention |
| 7-3 | 0.46 | 90 | +0.23 | −25.7 | |
| 7-4 | 0.47 | 110 | +0.11 | −12.3 | Within the scope |
| 7-5 | 0.46 | 110 | +0.10 | −11.5 | of the invention |
| 7-6 | 0.47 | 110 | +0.09 | −10.9 | |
| 7-7 | 0.47 | 115 | +0.10 | −11.8 | |
| 7-8 | 0.46 | 110 | +0.09 | −11.0 | |
| 7-9 | 0.47 | 112 | +0.09 | −11.3 | |
| 7-10 | 0.46 | 112 | +0.08 | −9.8 | |
| 7-11 | 0.46 | 112 | +0.08 | −9.5 | |
| 7-12 | 0.46 | 115 | +0.07 | −9.0 | |
| 7-13 | 0.47 | 112 | +0.12 | −13.5 | |
| 7-14 | 0.46 | 115 | +0.10 | −12.0 | |
| 7-15 | 0.46 | 110 | +0.10 | −11.7 | |
| 7-16 | 0.45 | 108 | +0.12 | −13.0 | |

As Table 13 shows, sample Nos. 7-4 to 7-16 of the present invention had high sensitivity and, in addition, they could be stored in a hot atmosphere without experiencing any substantial increase in fogging or drop in sensitivity.

EXAMPLE 8

A sample of multi-layered color photographic element, No. 8-1, was prepared in the same manner as sample No. 6-1 was prepared in Example 6, except that yellow coupler YC-1 (see below) was used in layers 9 and 10. Additional samples, No. 8-2 to No. 8-20, were prepared as above except that the compounds shown in Table 14 were incorporated in layer 3, 4 or 5 in the amounts also shown in Table 14.

Two test pieces were prepared for each of the 20 samples, No. 8-1 to No. 8-20. One test piece was stored for 4 days at 55° C. and at 20% R.H. before it was processed photographically as in Example 2; and the other test piece was immediately exposed under white light through an optical wedge and processed thereafter.

The color images produced in the processed samples, No. 8-1 to No. 8-20, were subjected to the measurement of red fog and red sensitivity with a densitometer. The results are shown in Table 15, wherein red (R) sensitivity data are expressed in terms of relative values of the reciprocal of the exposure necessary to produce a minimum density (Dmin) plus 0.1, with the value for sample No. 8-1 being taken as 100. In addition, the granularity of each image was evaluated in terms of the standard deviation, multiplied by 1,000, of the variation in density that occurs when a dye image having a red density of Dmin plus 0.6 is scanned with a microdensitometer having a scanning aperture of 25 μm in diameter (in Table 15, granularity data are expressed as relative values, with the value for sample No. 8-1 being taken as 100).

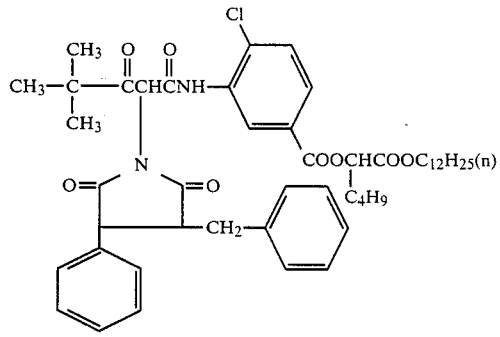

YC-1

TABLE 14

| Sample No. | DP' scavenger: Compound No. | DP' scavenger: Layer in which it was incorporated and its amount (mol/m²) | Compound 1: Name | Compound 1: Layer in which it was incorporated and its amount (mol/m²) | Remarks |
|---|---|---|---|---|---|
| 8-1 | — | — | — | — | Comparative samples |
| 8-2 | H-9 | layer 4 ($1.5 \times 10^{-4}$) | — | — | |
| 8-3 | P-6 | layer 4 ($1.5 \times 10^{-4}$) | — | — | |
| 8-4 | S-1 | layer 4 ($1.5 \times 10^{-4}$) | — | — | |
| 8-5 | C-12 | layer 4 ($1.5 \times 10^{-4}$) | — | — | |
| 8-6 | H-9 | layer 4 ($1.5 \times 10^{-4}$) | comparative compound (c) | layer 4 ($2 \times 10^{-6}$) | |
| 8-7 | P-6 | layer 4 ($1.5 \times 10^{-4}$) | comparative compound (c) | layer 4 ($2 \times 10^{-6}$) | |
| 8-8 | S-1 | layer 4 ($1.5 \times 10^{-4}$) | comparative compound (c) | layer 4 ($2 \times 10^{-6}$) | |
| 8-9 | C-12 | layer 4 ($1.5 \times 10^{-4}$) | comparative compound (c) | layer 4 ($2 \times 10^{-6}$) | |
| 8-10 | C-12 | layer 4 ($1.5 \times 10^{-4}$) | comparative compound (a) | layer 4 ($2 \times 10^{-6}$) | |
| 8-11 | C-12 | layer 5 ($4 \times 10^{-4}$) | — | — | |
| 8-12 | C-12 | layer 5 ($4 \times 10^{-4}$) | comparative compound (c) | layer 4 ($2 \times 10^{-6}$) | |
| 8-13 | H-9 | layer 4 ($1.5 \times 10^{-4}$) | No. 11 | layer 4 ($2 \times 10^{-6}$) | |
| 8-14 | P-6 | layer 4 ($1.5 \times 10^{-4}$) | No. 11 | layer 4 ($2 \times 10^{-6}$) | |
| 8-15 | S-1 | layer 4 ($1.5 \times 10^{-4}$) | No. 11 | layer 4 ($2 \times 10^{-6}$) | |
| 8-16 | *C-12 | layer 4 ($1.5 \times 10^{-4}$) | No. 20 | layer 4 ($2 \times 10^{-6}$) | |
| 8-17 | C-12 | layer 4 ($1.5 \times 10^{-4}$) | No. 8 | layer 4 ($2 \times 10^{-6}$) | |
| 8-18 | C-12 | layer 4 ($1.5 \times 10^{-4}$) | No. 11 | layer 4 ($2 \times 10^{-6}$) | |
| 8-19 | C-12 | layer 5 ($4 \times 10^{-4}$) | No.11 | layer 4 ($2 \times 10^{-6}$) | |
| 8-20 | C-12 | layer 4 ($1.5 \times 10^{-4}$) | No. 11 | layer 4 ($2 \times 10^{-6}$) | |

TABLE 15

| Emulsion No. | Immediately processed: R fog (A) | Immediately processed: R sensitivity | Immediately processed: R RMS | Processed after storage for 4 days to 55° C. × 20% R.H.: R fog (B) | Processed after storage for 4 days to 55° C. × 20% R.H.: R sensitivity | Processed after storage for 4 days to 55° C. × 20% R.H.: [B] - [A] | Remarks |
|---|---|---|---|---|---|---|---|
| 8-1 | 0.15 | 100 | 100 | 0.35 | 80 | 0.20 | Comparative samples |
| 8-2 | 0.17 | 105 | 92 | 0.44 | 65 | 0.27 | |
| 8-3 | 0.16 | 95 | 87 | 0.46 | 60 | 0.30 | |
| 8-4 | 0.18 | 100 | 89 | 0.43 | 70 | 0.25 | |
| 8-5 | 0.16 | 105 | 85 | 0.42 | 65 | 0.26 | |
| 8-6 | 0.16 | 80 | 95 | 0.38 | 55 | 0.22 | |
| 8-7 | 0.15 | 85 | 88 | 0.39 | 60 | 0.24 | |
| 8-8 | 0.15 | 75 | 92 | 0.36 | 70 | 0.21 | |
| 8-9 | 0.14 | 60 | 89 | 0.33 | 50 | 0.19 | |
| 8-10 | 0.15 | 80 | 93 | 0.39 | 70 | 0.24 | |
| 8-11 | 0.15 | 95 | 92 | 0.40 | 80 | 0.25 | |
| 8-12 | 0.14 | 55 | 94 | 0.31 | 50 | 0.17 | |
| 8-13 | 0.15 | 95 | 87 | 0.28 | 90 | 0.13 | |
| 8-14 | 0.16 | 105 | 83 | 0.32 | 95 | 0.16 | |
| 8-15 | 0.16 | 100 | 82 | 0.31 | 90 | 0.15 | |
| 8-16 | 0.15 | 105 | 78 | 0.25 | 100 | 0.10 | |
| 8-17 | 0.14 | 95 | 81 | 0.26 | 95 | 0.12 | |
| 8-18 | 0.14 | 110 | 72 | 0.21 | 115 | 0.07 | |
| 8-19 | 0.14 | 100 | 84 | 0.20 | 105 | 0.06 | |
| 8-20 | 0.13 | 105 | 70 | 0.19 | 115 | 0.06 | |

The following conclusions can be obtained from the data in Table 15:

(1) DP' scavengers used alone were effective in achieving improved granularity but, on the other hand, they caused high levels of fogging after storage in a hot atmosphere, which is a great problem for the performance of light-sensitive materials;

(2) when, with a view to eliminating this problem, DP' scavengers were used in combination with fog restrainers which were outside the scope of the present invention, a significant drop in sensitivity occurred and only a slight improvement was attained in the stability during storage in a hot atmosphere;

(3) only when DP' scavengers preferable for the purposes of the present invention were used in combination with the compound (I) of the present invention, images could be produced that had improved granularity without sacrificing their sensitivity and storage stability (in some cases, a slight increase in sensitivity was achieved); this result was more than expected by the present inventors.

EXAMPLE 9

Emulsions V and VI having the characteristics shown in Table 16 were prepared in the same manner as described in Example 5.

TABLE 16

| Emulsion | Average grain size (μm) | Spread of distribution (%) | AgI content (mol %) core | AgI content (mol %) inter-layer | AgI content (mol %) shell | Volume ratio (%) core | Volume ratio (%) inter-layer | Volume ratio (%) shell | Average AgI content (mol %) | Grain shape |
|---|---|---|---|---|---|---|---|---|---|---|
| V | 0.82 | 10 | 15 | 5 | 0.3 | 22 | 45 | 21 | 5.61 | octahedral |
| VI | 1.81 | 9 | 15 | 5 | 0.3 | 22 | 50 | 16 | 5.85 | octahedral |

As in Example 6, a sample No. 9-1 of multi-layered color photographic element was prepared by coating a triacetyl cellulose film base with successive layers having the compositions shown below, with the first layer positioned closest to the base.

Sample No. 9-1

First layer: anti-halation layer (HC-2) which was a gelatin layer containing black colloidal silver Second layer: intermediate layer (I.L.) which was a gelatin layer Third layer: less red-sensitive silver halide emulsion layer (RL-2) comprising Emulsion V that was coated for a silver (Ag) deposit of 1.9 g/m$^2$; this layer contained the following additional components: sensitizing dye XI, $2.0\times10^{-5}$ moles per mole mole per mole of silver; cyan coupler (C-1), 0.08 moles per mole of silver; colored cyan coupler (CC-1), 0.004 moles per mole of silver; DIR compound (D-1), 0.005 moles per mole of silver Fourth layer: intermediate layer (I.L.) which was a gelatin layer Fifth layer: less green-sensitive silver halide emulsion layer (GL-2) comprising Emulsion V that was coated for Ag deposit of 1.7 g/m$^2$; this layer contained the following additional components: sensitizing dye XIII, $1.2\times10^{-5}$ moles per mole of silver; sensitizing dye XIV, $1.2\times10^{-5}$ moles per mole of silver; magenta coupler (Compound No. 4 in the list of magenta couplers given in this specification), 0.06 moles per mole of silver; colored magenta coupler (CM-1), 0.012 moles per mole of silver Sixth layer: intermediate layer (I.L.) which was a gelatin layer Seventh layer: less blue-sensitive silver halide emulsion layer (BL-2) comprising Emulsion V that was coated for Ag deposit of 1.0 g/m$^2$; this layer containing the following additional components: sensitizing dye XV, $1.0\times10^{-5}$ mole per mole of silver; yellow coupler (Compound Y-16 in the list of yellow couplers given in this specification), 0.35 moles per mole of silver; DIR compound (D-1), 0.001 mole per mole of silver Eighth layer: intermediate layer (I.L.) which was a gelatin octyl hydroquinone Ninth layer: highly red-sensitive silver halide emulsion layer (RH-2) comprising Emulsion VI that was coated for Ag deposit of 2.4 g/m$^2$; this layer contained the following additional components: sensitizing dye XI, $1.1\times10^{-5}$ moles per mole of silver; sensitizing dye XII, $5.0\times10^{-6}$ moles per mole of silver; cyan coupler (C-1), 0.03 moles per mole of silver; colored cyan coupler (CC-1), 0.002 moles per mole of silver; DIR compound (D-1), 0.0004 moles per mole of silver Tenth layer: intermediate layer (I.L.) which was a gelatin layer containing a dispersion of 2,5-di-t-octyl hydroquinone Eleventh layer: highly green-sensitive silver halide emulsion layer (GH-2) comprising Emulsion VI that was coated for Ag deposit of 2.0 g/m$^2$; this layer contained the following additional components: antifoggant compound (No. 11), 100 mg per mole of silver; sensitizing dye XIII, $4.0\times10^{-6}$ moles per mole of silver; sensitizing dye XIV, $4.0\times10^{-6}$ moles per mole of silver; magenta coupler (Compound No. 4 in the list of magenta couplers given in this specification), 0.020 moles per mole of silver; colored magenta coupler (CM-1), 0.002 moles per mole of silver Twelfth layer: intermediate layer (I.L.) which was a gelatin layer containing a dispersion of 2,5-di-t-octyl hydroquinone Thirteenth layer: highly blue-sensitive silver halide emulsion layer (BH-2) comprising Emulsions V and VI, as well as a monodispersed emulsion (Emulsion VII) that was composed of AgBrI grains (2 mole % AgI) having an average size of 0.27 μm; this layer was coated for Ag deposit of 2.1 g/m$^2$ and contained the following additional components: antifoggant compound (No. 11), 100 mg per mole of silver; sensitizing dye XV, $7.0\times10^{-6}$ moles per mole of silver; yellow coupler (Compound Y-16 in the list of yellow couplers given in this specification), 0.08 moles per mole of silver; DIR compound (D-1), 0.0007 moles per mole of silver:

Fourteenth layer: first protective layer (Pro-3) which was a gelatin layer containing AgBrI grains (1 mol % AgI; average size, 0.07 μm) coated for Ag deposit of 0.2 g/m$^2$, as well as uv absorbers, UV-1 and UV-2

Fifteenth layer: second protective layer (Pro-4) which was a gelatin layer containing polymethyl methacrylate particles (1.5 μm, in dia.) and a formaldehyde scavenger (HS-1).

Each of the layers 1 to 15 also contained gelatin hardeners (H-1 and H-2) and a surfactant as required. Two test pieces were prepared for sample No. 9-1; one test piece was immediately exposed under white light through an optical wedge and subsequently processed as in Example 2; the other test piece was stored for 5 days at 55° C. and at 20% R.H. before processed photographically. The results are shown in Table 17, from which one can see that the sample of the present invention was highly stable in a hot atmosphere and produced color images that experienced small amounts of thermal fogging.

TABLE 17

| | Variation in fog upon thermal treatment |
|---|---|
| B | +0.01 |
| G | +0.02 |
| R | +0.01 |

EXAMPLE 10

Sample No. 9-1 which was prepared in Example 9 was slit to films measuring 3.5 cm wide and 120 cm long, which were then rolled in several cartridges. The slitting and rolling operations were performed in the dark.

The cartridges were left to stand for 3 days at 25° C. and at four different relative humidities, 45%, 53%, 57% and 62%. Thereafter, the cartridges were enclosed in polypropylene cases under the respective humidity conditions and divided into two groups; one group of cartridges were left to stand for an additional 7 days at 60° C., and the other group of cartridges were stored for 7 days at 5° C. in an atmosphere that was substantially free from any time-dependent change.

The cartridges stored at 60° C. for 7 days were transferred into an atmosphere of 25° C. and 55% R.H. and recovered from their cases. After 25 seconds and 3 days, the weights of these cartridges were measured with a direct-reading balance produced by Shimadzu Corporation. The change in the weight of each cartridge was calculated by subtracting the weight measured after 25 seconds from the value measured after 3 days. The results are shown in Table 18.

TABLE 18

| Humidity (% R.H.) | Change in weight (mg) |
|---|---|
| 45 | +32 |
| 53 | +7 |
| 57 | −7 |
| 62 | −24 |

The samples in the cartridges left to stand for 7 days at 60° C. and those in the cartridges stored for 7 days at 5° C. were imagewise exposed and subjected to color photographic processing in the same manner as used in Example 9. The values of fog that occurred in the blue images produced in the processed samples were measured and the variation in fog was calculated for each sample by subtracting the value of fog occurring after storage at 5° C. from the value of fog occurring after standing at 60° C. The results are shown in Table 19.

TABLE 19

| | (Blue density) |
|---|---|
| Humidity (% R.H.) | Variation in fog |
| 45 | +0.02 |

TABLE 19-continued

| | (Blue density) |
|---|---|
| Humidity (% R.H.) | Variation in fog |
| 53 | +0.02 |
| 57 | +0.05 |
| 62 | +0.07 |

As Table 19 shows, sample No. 9-1 prepared in accordance with the present invention experienced small variations in fog even when it was processed after exposure to hostile conditions. The variation in fog that occurred in this sample on account of thermal treatment was particularly small when it was conditioned to humidities of less than

What is claimed is:

1. A silver halide photographic material comprising a support which is coated with photographic layers including one or more silver halide emulsion layers, said emulsion being a negative-working emulsion containing surface latent image type grains, at least one of said silver halide emulsion layers containing silver halide grains with a silver iodide content of 3.0–15 mol %, and at least one of said photographic layers containing a compound represented by the following formula (I):

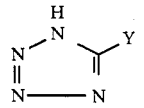

where Y is a 5- or 6-membered heterocyclic group selected from the group consisting of 2-pyridyl, 3-pyridyl, 4-pyridyl, 2-quinolyl, 3-quinolyl, 4-quinolyl, 6-quinolyl, 2-thienyl, 3-furyl, 3-pyrolyl, 2-imidazolyl, 2-pyrimidinyl, 3-pyridazinyl, 3-isoquinolyl, 2-thiazolyl, and 5,6-benzo-1,4-diazinyl, the compound of formula (I) being present in an amount effective to inhibit the occurrence of fogging.

2. A silver halide photographic material according to claim 1, wherein said silver halide grains with a silver iodide content of 3.0–15 mol % are core/shell type silver halide grains.

3. A silver halide photographic material according to claim 1, which contains a yellow dye forming coupler represented by the following formula (Y):

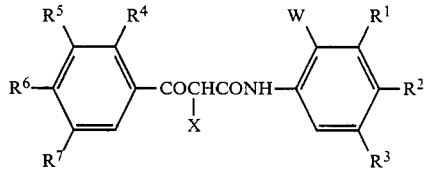

(Y)

where $R^1$, $R^2$ and $R^3$, which may be the same or different, each represents a hydrogen atom, a halogen atom, an alkyl group, an aryl group, an alkoxy group, an acylamino group, a carbamoyl group, an alkoxycarbonyl group, a sulfonamide group or a sulfamoyl group; $R^4$, $R^5$, $R^6$ and $R^7$, which may be the same or different, each represents a hydrogen atom, an alkyl group, an alkoxy group, an aryloxy group, an acylamino group or a sulfonamide group; W represents a halogen atom, an alkyl group, an alkoxy group, an aryloxy group or a dialkylamino group; and X represents a hydrogen atom or a group capable of leaving upon coupling reaction with the oxidized product of a color developing agent.

4. A silver halide photographic material according to claim 1, which contains at least one magenta dye forming coupler selected from those represented by the following formulas (M-1) and (M-2):

(M-1)

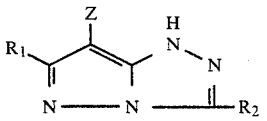

(M-2)

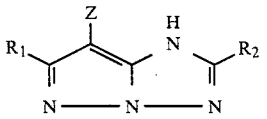

where $R_1$ and $R_2$ each represents an alkyl group, an aryl group or a heterocyclic group, or an alkyl, aryl or heterocyclic group bonded through an oxygen atom, a nitrogen atom or a sulfur atom, or an alkyl, aryl or heterocyclic group bonded through an acylamino group, a carbamoyl group, a sulfonamide group, a sulfamoylcarbonyl group, a carbonyloxy group, an oxycarbonyl group, a ureide group, a thioureide group, a thioamide group, a sulfo group or a sulfonyloxy group; and Z represents a hydrogen atom or a group which leaves upon formation of a dye through coupling with the oxidized product of an aromatic primary amine color developing agent.

5. A silver halide photographic material according to claim 1, which contains a compound that reacts with the oxidized product of a color developing agent as a function of the development of silver halide emulsion layers but that does not contribute to image formation.

* * * * *